US009554626B2

(12) United States Patent
Gellert et al.

(10) Patent No.: US 9,554,626 B2
(45) Date of Patent: Jan. 31, 2017

(54) EASY RELEASE COMPOUND ASSEMBLIES COMPRISING A LOCKING ARRANGEMENT

(76) Inventors: Peter Gellert, Marion, NC (US); Russell W. Warnock, Asheville, NC (US)

( * ) Notice: Subject to any disclaimer, the term of this patent is extended or adjusted under 35 U.S.C. 154(b) by 0 days.

(21) Appl. No.: 14/424,635

(22) PCT Filed: Sep. 4, 2012 (Under 37 CFR 1.47)

(86) PCT No.: PCT/US2012/000383
§ 371 (c)(1), (2), (4) Date: Nov. 30, 2015

(87) PCT Pub. No.: WO2013/036277
PCT Pub. Date: Mar. 14, 2013

(65) Prior Publication Data

US 2016/0135549 A1 May 19, 2016

Related U.S. Application Data

(60) Provisional application No. 61/531,734, filed on Sep. 7, 2011, provisional application No. 61/675,623, filed on Jul. 25, 2012.

(51) Int. Cl.
*A44B 11/25* (2006.01)
*A45C 13/10* (2006.01)

(52) U.S. Cl.
CPC ..... *A44B 11/2592* (2013.01); *A45C 13/1084* (2013.01)

(58) Field of Classification Search
CPC ..... A44B 11/2592; A44B 11/2596; A45C 13/1084; A45C 13/1092; Y10T 24/32
See application file for complete search history.

(56) References Cited

U.S. PATENT DOCUMENTS 2,956,324 A * 10/1960 Klein ..... A44B 11/2596 24/323
8,359,716 B2 * 1/2013 Fiedler ..... A44B 11/25 24/303

FOREIGN PATENT DOCUMENTS

DE WO 2009103279 A2 * 8/2009 ..... A44B 11/25
FR 2215907 A1 * 8/1974 ..... A41F 1/006

* cited by examiner

*Primary Examiner* — Abigail Morrell
(74) *Attorney, Agent, or Firm* — Luedeka Neely Group, P.C.

(57) ABSTRACT

There is provided a locking arrangement that includes an entry element and a housing element, the entry element having a portion that is selectively disposable in the housing element via a movement of the portion of the entry element and the housing element relatively toward one another in an insertion direction, the entry element and the housing element being in a releasably secured disposition when the portion of the entry element has been disposed in the housing element via a movement of the portion of the entry element and the housing element relatively toward one another in the insertion direction and the entry element and the housing element being releasable from their releasably secured disposition via a movement in a release direction that is other than a direction opposite to the insertion direction.

11 Claims, 29 Drawing Sheets

EASY RELEASE COMPOUND ASSEMBLIES COMPRISING A LOCKING ARRANGEMENT

BACKGROUND OF THE INVENTION

The present invention generally relates to buckles for connecting together webs and straps that are deployed in many disparate applications including the securing the two ends of a belt together, the closure of backpacks and other bags and sacks, and the fastening of vests, jackets, and other garments. Buckle locking arrangements are known that comprise two portions which can be releasably secured to one another and these buckle locking arrangements include an entry portion and a housing portion. Each of the housing and entry portions may optionally be connected to a respective structure such as, e.g. a strap, belt, cord, chain, tether, or other item. One well known buckle, often called a side release buckle, comprises two parts securable to respective web straps, one of the parts (the tang part) consists of a pair of prongs, each having an outwardly extending prong end and the other part (the housing part) having a channel into which the prongs can be pushed. The width of the channel is smaller than the distance between the outsides of the prongs and so, as the tang part is pushed into the channel, the prongs are flexed inwardly by the outer walls of the channel. The walls include a pair of openings into which the prong ends can snap when the tang part has been inserted into the channel. The engagement of the prong ends in the channel wall openings retains the two parts together.

To release such a side release buckle, the prong ends are pinched to move towards each other thereby releasing the prong ends from the openings and allowing the tang part to be withdrawn from the housing part.

Because the openings are exposed, it is possible for the fingers of a user to be caught between the prong end and the opening and this leads to inconvenience and engenders anxiety about opening the buckle.

U.S. Pat. No. 6,226,844 to Lerra et al describes various configurations of side release buckles.

While the reliability and convenience of quick release buckles have been demonstrated, there still remains a need for a quick release buckle that provides even greater convenience to a user and that can be released from its closed disposition with only a different motion than the coordinated motion of two fingers as is required to release a side release buckle.

SUMMARY OF THE INVENTION

It is an object of the present invention to provide a quick release buckle that provides convenience to a user and that can be released from its closed disposition with only a single finger motion.

According to one aspect of the present invention, there is provided a quick release buckle that has two portions which can be releasably secured to one another. The quick release buckle comprises an entry portion and a housing portion. Each of the housing and entry portions may optionally be connected to a respective structure such as, e.g. a strap, belt, cord, chain, tether, or other item, and the quick release buckle can then be beneficially deployed to releasably couple the respective structures connected to the entry and housing portions to one another.

According to one aspect of the present invention, there is provided a locking arrangement that includes an entry element and a housing element, the entry element having a portion that is selectively disposable in the housing element via a movement of the portion of the entry element and the housing element relatively toward one another in an insertion direction, the entry element and the housing element being in a releasably secured disposition when the portion of the entry element has been disposed in the housing element via a movement of the portion of the entry element and the housing element relatively toward one another in the insertion direction and the entry element and the housing element being releasable from their releasably secured disposition via a movement in a release direction that is other than a direction opposite to the insertion direction.

Other features and advantages of the invention will become apparent to those skilled in the art upon review of the following detailed description, claims, and drawings.

BRIEF DESCRIPTION OF THE DRAWINGS

FIGS. 1A, 1B, 1C, and 1D each show one view of the locking arrangement with the housing and entry portions engaged in a locked position of the locking arrangement, wherein FIG. 1A is a top view, FIG. 1B is a top perspective view, FIG. 1C is a side view, and FIG. 1D is a top view;

FIGS. 2A, 2B, 2C, and 2D each show one view of the housing portion of the locking arrangement, wherein FIG. 2A is a top view, FIG. 2B is a top perspective view, FIG. 2C is a side view, and FIG. 2D is a front view;

FIGS. 3A, 3B, 3C, and 3D each show one view of the entry portion of the locking arrangement, wherein FIG. 3A is a top view, FIG. 3B is a top perspective view, FIG. 3C is a side view, and FIG. 3D is a front view;

DETAILED DESCRIPTION

The locking arrangement has two portions which can be releasable secured to one another in the form of an entry portion and a housing portion. Each of the housing and entry portions may optionally be connected to a respective structure such as, e.g. a strap, belt, cord, chain, tether, or other item, and the locking arrangement can then be beneficially deployed to releasably couple the respective structures connected to the entry and housing portions to one another.

A bump element in the form of a recess is provided in the housing portion and a bump element in the form of a projection is provided in the entry portion such that the two bump elements releasably interconnect with one another in the locked position of the locking arrangement to resist an inadvertent or undesired disengagement of the entry and housing portions from one another. As the locking arrangement is moved out of its locked position, the bump elements move out of their releasably interconnected disposition and this movement can occur, e.g., as a result of flexing of the housing portion (part A) at a pair of its ends.

A void is provided in the housing portion and a void such as, e.g., a pair of parallel slots, are provided in the entry portion for attaching the portions to an item such as a strap, cord, lanyard, boot, shoe, or any item, fixed or flexible. The locking arrangement is convenient for circumstances in which two respective ends of the same item such as, e.g., a strap, or two ends of two different items are to be reversibly or releasably joined to one another. A single void or multiple voids can be provided as desired on each of the entry and housing portions.

The locking arrangement can be configured to provide more resistance to a release movement via the configuration of the bumps with relatively larger dimensions or via configuration of the locking arrangement with relatively greater resistance to flexing. A disengagement of the entry and housing portions requires a light yank or a steady pull on a respective one of the entry and housing portions while the other portion is effectively restrained from substantial movement in the same respective direction as the direction of the yank or steady pull. The locking arrangement can be optionally configured such that an insertion operation of the entry and housing portions to place the locking arrangement in its locked position results in a sound that is audible at a selected minimum and/or maximum spacing from the locking arrangement and this sound can be relied upon to confirm that the locking arrangement is locked. As well, a user can view the word "LOCK" with its letters at their prescribed spacing from one another to confirm that the locking arrangement is locked.

Figure 1A:
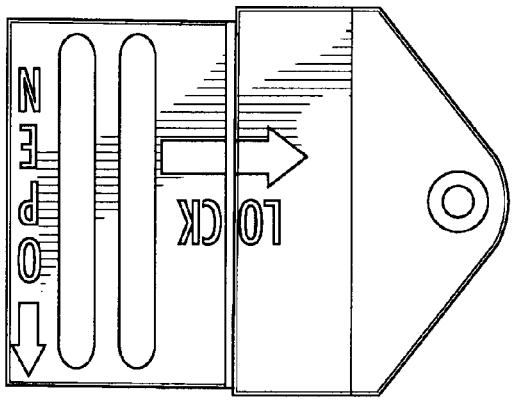
Figure 1B:
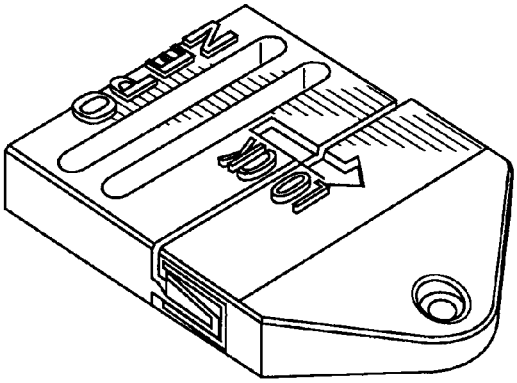
Figure 1C:
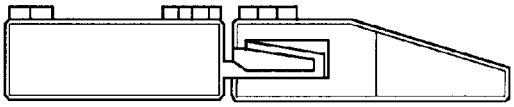
Figure 1D:
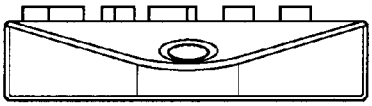
Figure 2A:
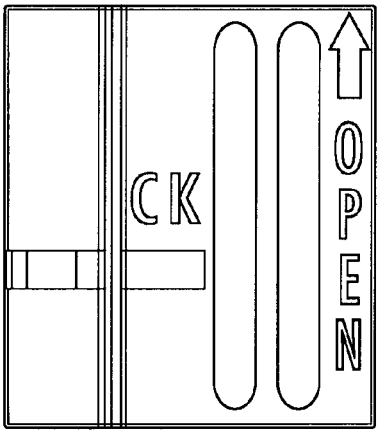
Figure 2B:
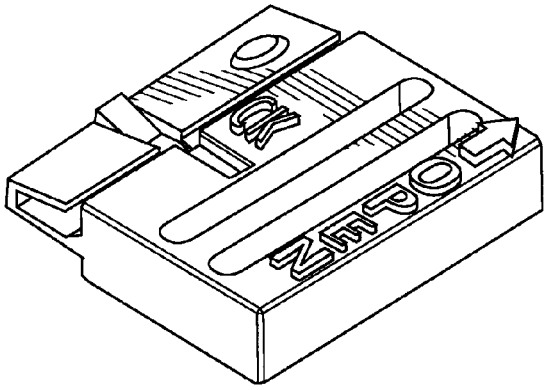
Figure 2C:
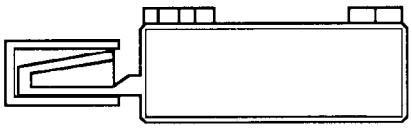
Figure 2D:
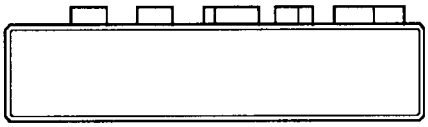
Figure 3A:
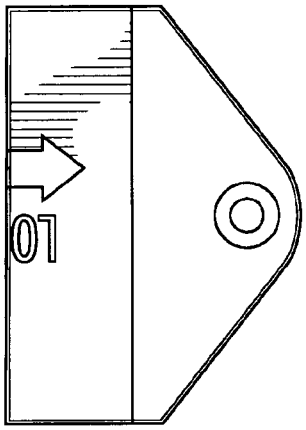
Figure 3B:
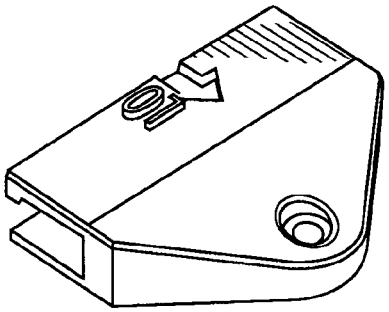
Figure 3C:
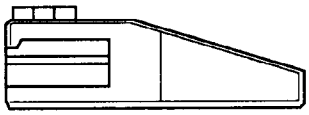
Figure 3D:
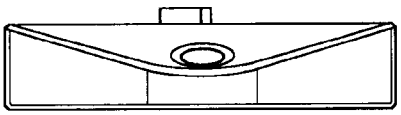
Figure 4:
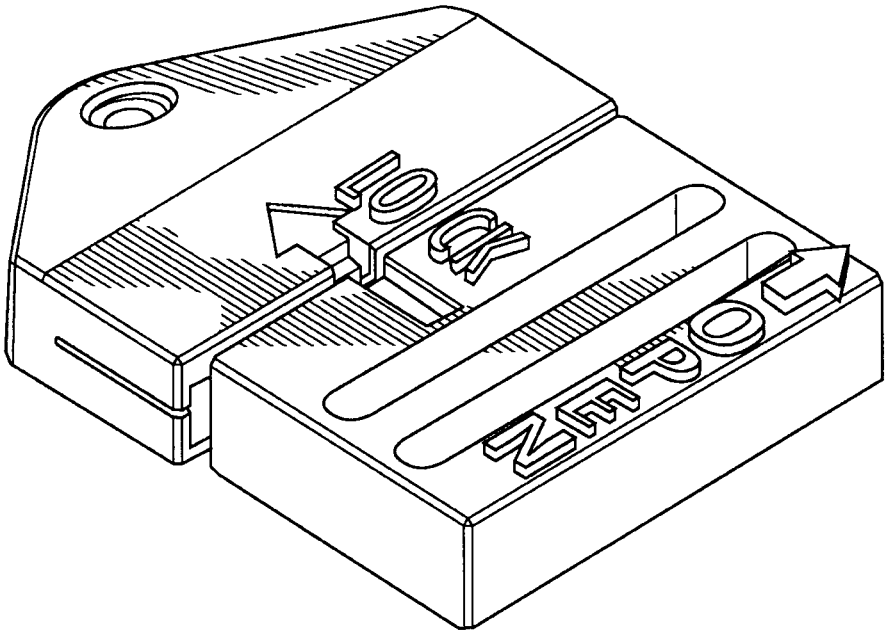
FIG. 4 is an enlarged top perspective view of the locking arrangement with the housing and entry portions engaged in a locked position of the locking arrangement, and showing optional letters and directional arrows with one set of letters spelling the word "OPEN" and associated with one directional arrow and a second set of letters spelling the word "LOCK" and associated with another directional arrow.
Figure 5:
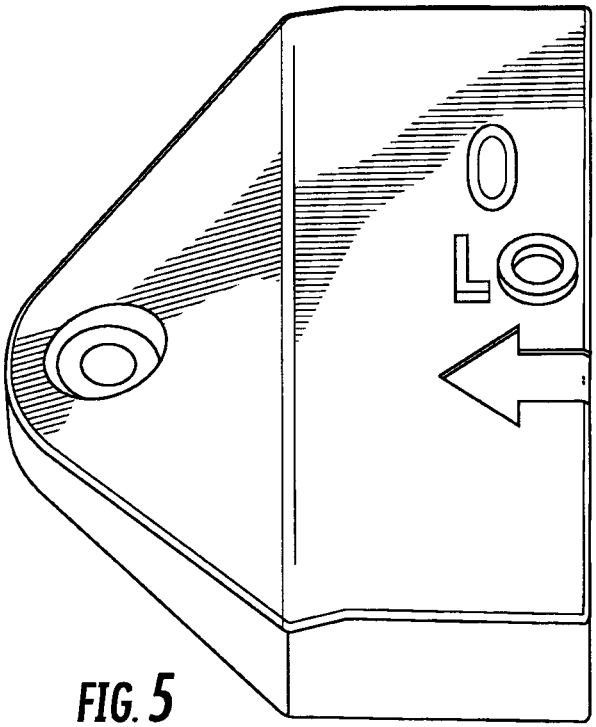
FIG. 5 is an enlarged top perspective view of the housing portion of the locking arrangement and showing the location of a bump element on an interior surface of a ceiling wall of the housing portion.
Figures 6, 7:
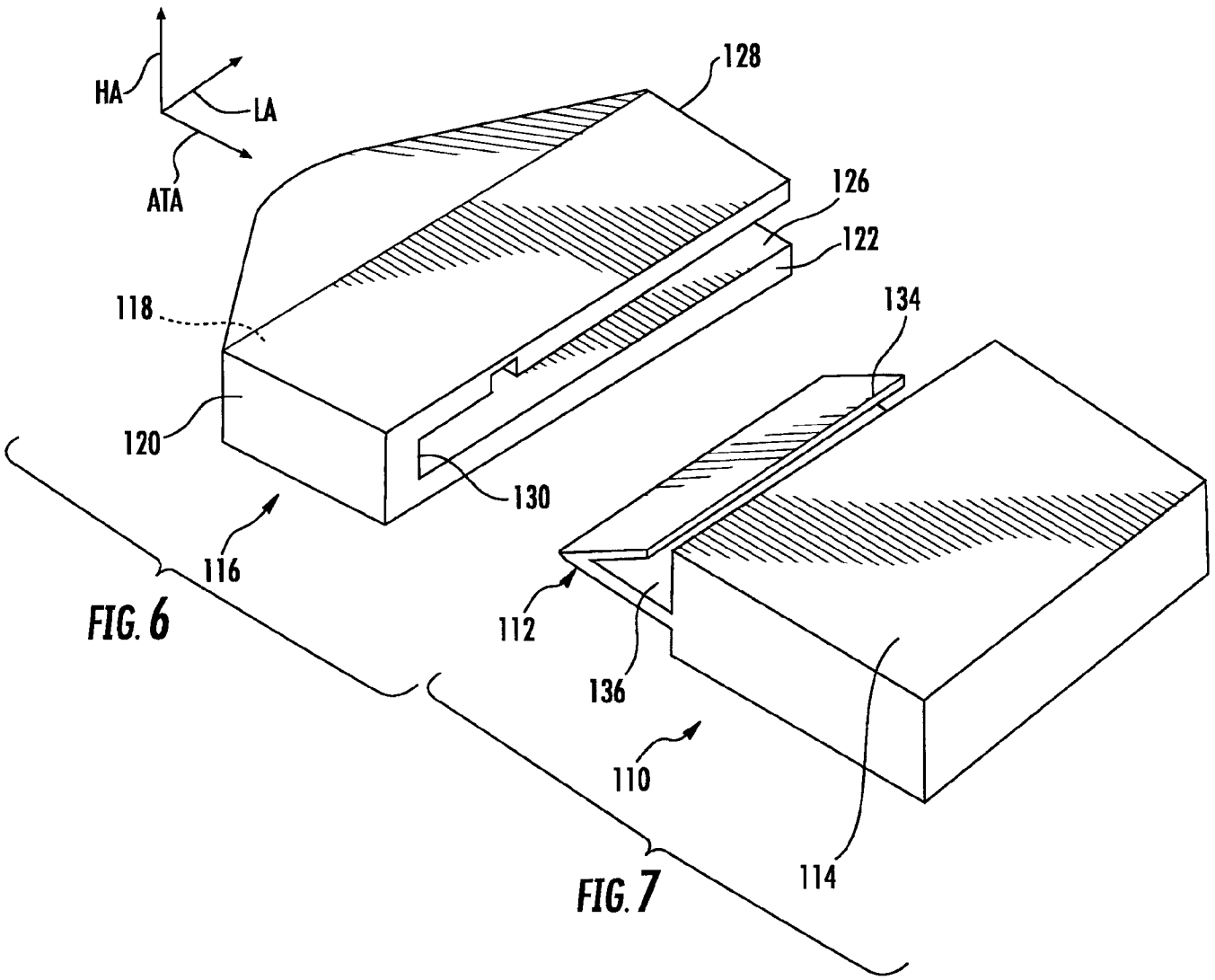
FIG. 6 is a perspective view of a three axis reference legend.
FIG. 7 is a perspective top view of the locking arrangement in an unlocked position of the locking arrangement with the housing portion and the entry portion not in fully connected engagement with one another.
Figure 8:
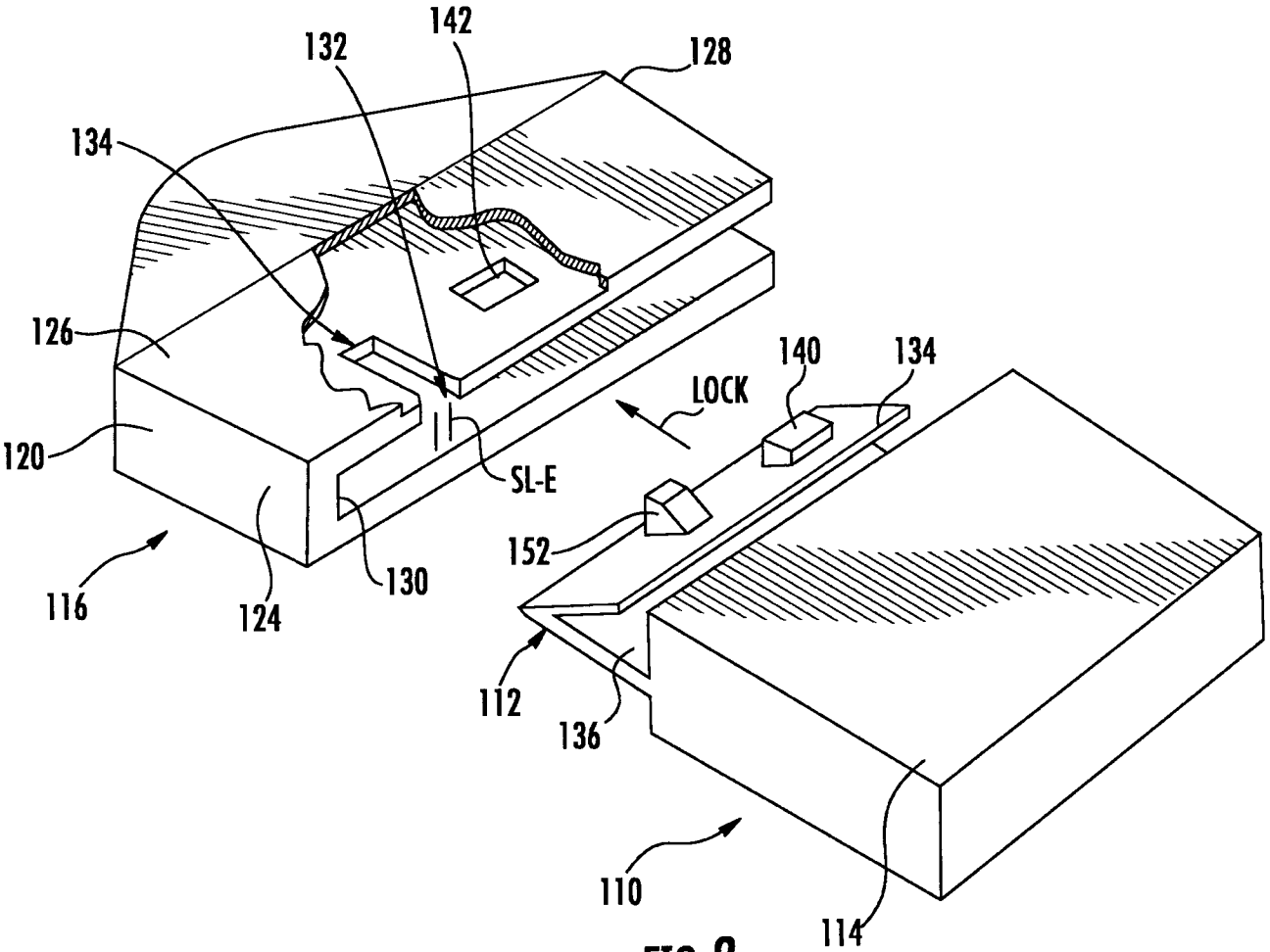
FIG. 8 is a perspective top view in partial section of the locking arrangement shown in FIG. 7.

The configuration of the bump elements and the manner of flexing of one or both of the entry and housing portions can be accomplished in other shapes such as a slide-in/slide-out vertical unit shaped as a dove tail, or other shapes as desired. One exemplary configuration of the locking arrangement shown in FIGS. 1-5 is described with reference to FIG. 6, which shows a three axis reference legend. FIG. 7, which is a perspective view of the locking arrangement, FIG. 8, which is a perspective partial sectional view of the locking arrangement, and FIG. 9, which is a perspective view of a portion of the entry element and a portion of the housing element of the locking arrangement in the locked position of the locking arrangement. With reference initially to FIGS. 7 and 8, further details of the operation of the locking arrangement will now be described. The entry portion is in the form of an entry element 110 and the entry element 110 includes a tang component 112 and a strap connecting component 114. The housing portion is in the form of a housing element 116 and includes a back wall 118, a closed side wall 120, a front slot wall 122, a floor 124, a ceiling wall 126, and an exit side wall 128. The front slot wall 122 includes a rectangular slot 130. The various walls of the housing element 116 delimit an interior volume dimensioned with respect to the tang component 112 of the entry element 110, in a manner to be described in more detail, such that the tang component 112 is received within the interior volume delimited within the housing element 116 in a lock position of the locking arrangement. The description of the entry element 110 and the housing element 112 will be provided with reference to a three axis reference system comprised of a height axis HA, a longitudinal axis LA at ninety (90) degrees to the height axis HA, and a lateral axis ATA at ninety (90) degrees to both the height axis HA and the longitudinal axis LA.

The housing element 116 also includes a stop ledge 132 that extends along the longitudinal dimension of the front slot wall 122 at a location above the slot 130 and the stop ledge 132 extends to the ceiling wall 126. The stop ledge 132 has a lateral dimension, as viewed parallel to the lateral extent of the closed side wall 120, that is less than the lateral extent of the closed side wall 120 and this lateral extent of the stop ledge 132, designated as the stop ledge lateral extent SL-E, is configured in correspondence with the dimensions of the tang component 112 of the entry element 110 so as to engage a predetermined extent of the tang component 112, in a manner that will be described in more detail.

The entry element 110 may be formed, for example, of a suitable plastic material, a metal material, a combination of a metal and plastic material, or any other suitable material. The entry element 110 is configured to be inserted through the slot 130 of the housing element 116 along a lock insertion axis LO-IX, whereupon the insertion of the entry element 110 through the slot 130 is performed in a series of steps comprising a step of orienting the tang component 112 of the entry element 110 such that the longitudinal dimension of the tang component 112 is parallel to the longitudinal dimension of the slot 130 and a step of advancing the entry element 110 in the locking arrangement insertion direction LO-IX such that the tang component 112 moves inwardly into the housing element 116 laterally beyond the front slot wall 122, with the insertion of the tang component 112 ceasing once a top longitudinal edge 134 of the tang component 112 has advanced inwardly into the housing element 116 beyond the stop ledge 132. The tang component 112 of the entry element 110 is configured with a "V"—cross-sectional shape such that the top longitudinal edge 134 of the tang component 112 can be forced in the height axis HA direction toward a tang base 136 against a resilient bias of the tang component and this resilient bias of the tang component 112 automatically returns the top longitudinal edge 134 to its non-pressed position once a pressing force on the tang component has ceased.

The height of the slot 130 of the housing element 116, is measured in the direction of the height axis HA, is configured such that the insertion movement of the tang component 112 of the entry element 110 results in a downward pressure being applied to the tang component 112 by the top of the slot 130 so as to press the top longitudinal edge 134 of the tang component 112 in a downward direction relative to the height axis HA toward the tang base 136 against the resilient bias of the tang component 112. This downward pressure on the tang component 112 of the entry element 110 continues until the top longitudinal edge 134 of the tang component 112 has advanced laterally beyond the stop ledge 132 of the housing element 116, whereupon the resilient bias of the tang component 112 restores the top longitudinal edge 134 to its non-depressed position once the top longitudinal edge 134 has been advanced beyond the stop ledge 132 of the housing element 116. Once the top longitudinal edge 134 of the tang component 112 has advanced laterally beyond the stop ledge 132 of the housing element 116, any movement, to promote withdrawal of the tang component 112 of the entry element 110 in the direction opposite to the locking arrangement insertion direction LO-IX is resisted via the engagement by the stop ledge 132 of the housing element 116 with the top longitudinal edge 134 of the tang component 112 of the entry element 110. A release of the entry element 110 from the housing element 116 is effected via a movement of the entry element 110 and the housing element 116 relative to one another in a direction parallel to the longitudinal axis LA and this direction is ninety (90) degrees to the lateral axis ATA. For example, the entry element 110 can be moved in a direction parallel to the longitudinal axis LA in a direction from the closed side wall 124 of the housing element 116 toward the exit side wall 128 of the housing element 116. The exit side wall 128 of the housing element 116 is provided with an exit slot 138 that extends along the entire lateral dimension of the exit side wall, is communicated with the slot 130 and is compatibly configured with respect to the dimensions of the tang component 112 of the entry element 110 such that the tang component 112 can be advanced outwardly through the exit slot 138 during a release movement of the entry element 110 from the housing element 116 in a direction parallel to the longitudinal axis LA. During such a release movement, the tang component 112 of the entry element 110 may remain in its configuration in which the top longitudinal edge 134 is not pressed toward the tang base 136 or, alternatively, the dimensions of the exit slot 138, or the presence of another structure within the interior volume of the housing element 116, may result in an engagement of the tang component 112 during the release movement such that the tang component is pressed in a manner to move the top longitudinal edge 134 toward the tang base 136.

The longitudinal edge 134 of the tang component 112 of the entry element 110 is provided with a projection 140 that projects laterally in a direction parallel to the height axis HA and this projection 140 is received within a recess 142 of the housing element 116 compatibly configured with the projection. The recess 142 is formed in the ceiling wall 126 of the housing element 116. Thus, unintended or inadvertent applications of force to the entry element 110 or the housing element 116, in the locked position of the locking arrangement, that would promote movement of the entry element 110 laterally through the exit slot 138 of the exit side wall 128 of the housing element 116 are resisted via the releasable seating of the projection 140 of the tang component 112 of the entry element 110 within the recess 142 of the housing element 116. The engagement of the projection 140 in the recess 142 can be overcome via the application of a suitable force such as, for example, a force above a minimum force that would be applied in the event that an intended release movement of the entry element 110 is desired to effect the release of the entry element 110 from the housing element 116.

The housing element 116 can be optionally provided with a biasing component on the interior surface of the closed sidewall 120, on the interior surface of the back wall 118, or on any of the walls for the purpose of biasing the entry element 110 into a preferred orientation relative to the housing element 116 or for biasing the entry element 110 to move in a preferred manner relative to the housing element 116. For example, the biasing component on the interior surface of the back wall 118 may be, e.g., a spring or a springy plastic component, and this biasing component can be resilient compressed by the tang component 112 of the entry element 110 via a lateral insertion of the tang component 112 along the locking direction LO-IX into the interior volume of the housing element 116. The thereby-compressed biasing component on the interior surface of the back wall 118 will then bias or urge the tang component 112 of the entry element 110 in a direction opposite to the locking direction LO-IX and thereby maintain the tang component 112 of the entry element 110 in engagement with the stop ledge 132 of the housing element 116.

Figure 9:
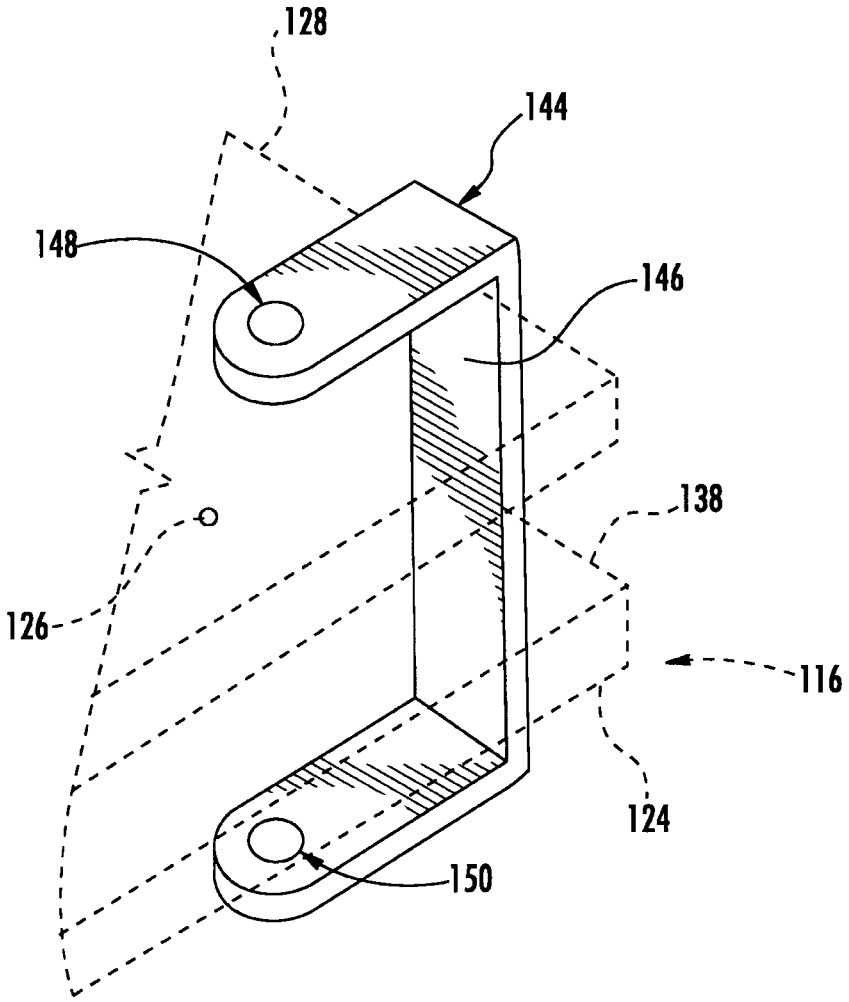
FIG. 9 is an enlarged top perspective view of a portion of the entry element and a portion of the housing element of the locking arrangement in the locked position of the locking arrangement.

The housing element 116 is provided with a selectively releasable strap connector 144 that is comprised of a strap 146 having a top snap fastener 148 and a lower snap fastener 150. As seen in FIG. 9, which is a perspective view of a portion of the entry element 110 and a portion of the housing element 116 in the locked position of the locking arrangement, the top snap fastener 148 is releasably engaged with a fastener component (not shown) on the ceiling wall 126 of the housing element 116 and the lower snap fastener 150 is releasably engaged with a fastener component (not shown) on the floor 124 of the housing element 116 in a blocking position of the strap connector 144. In this blocking position, the strap connector 144 extends in a direction parallel to the height axis HA across the front face of the exit slot 138 of the exit side wall 128 of the housing element 116 and operates to oppose a release movement of the tang component 112 of the entry element 110 in a direction from the closed side wall 124 toward the exit side wall 128 of the housing element 116. If a user desires to release the entry element 110 from the housing element 116, the user disengages either or both of the snap fasteners 148, 150 of the strap connector 144 from their respective snap engaged positions with the housing element 116 and the strap connector 144 then will no longer oppose a release movement of the entry element 110.

As seen in FIG. 8, the entry element 110 is provided with an insertion guide rib 152 projecting laterally from the tang component 112 and the housing element 116 is provided with a guide cut-out 154 compatibly configured with respect to the insertion guide rib 152 to receive the rib therein as the tang component 112 is inserted through the slot 130 of the housing element 116. The insertion guide rib 152 of the tang component 112 and the guide cut-out 154 of the housing element 116 cooperate together to ensure a predetermined longitudinal orientation of the entry element 110 relative to the housing element 116.

Although the locking arrangement in the exemplary configuration shown in FIGS. 7-9 has been described as having the tang component 112 of the entry element 110 configured as a resilient deflectable structure, it is also optionally available that the housing element 116 could be resiliently deflectable in connection with either an insertion of the entry element 110 into the housing element 116 or a release movement of the entry element 110 relative to the housing element 116 or both an insertion of the entry element 110 into the housing element 116 and a release movement of the entry element 110 relative to the housing element 116. Additionally, both the housing element 116 and the entry element 110 can be configured as resiliently deflectable structures that each respectively resiliently deflect and then return to original configurations in connection with either an insertion of the entry element 110 into the housing element 116 or a release movement of the entry element 110 relative to the housing element 116 or both an insertion of the entry element 110 into the housing element 116 and a release movement of the entry element 110 relative to the housing element 116. The resilient deflection capability of the housing element 116 or the entry element 110 can be imparted, for example, by a property of a constituent material or can be provided by a mechanical structure having moving parts.

Figure 10:
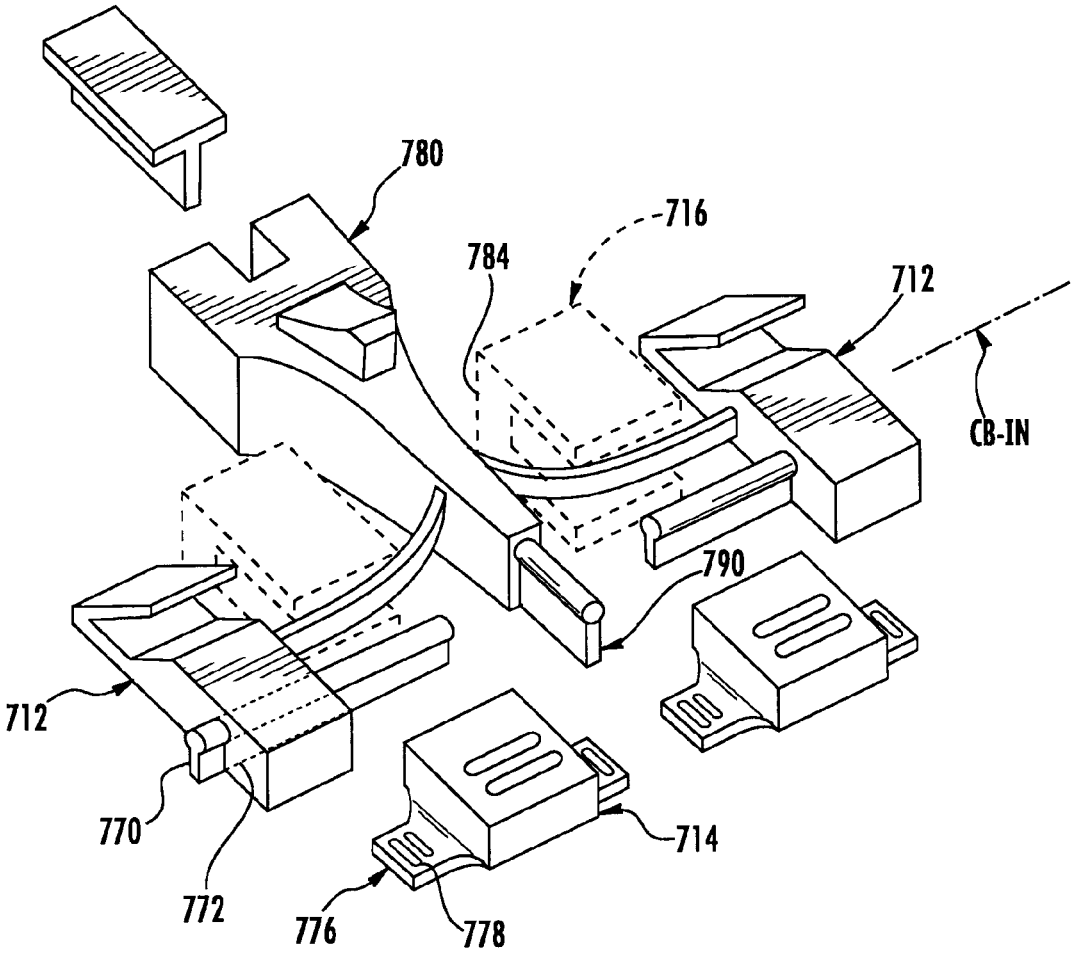
FIG. 10 is an enlarged perspective view of a variation of the buckle of the present invention.
Figure 11:
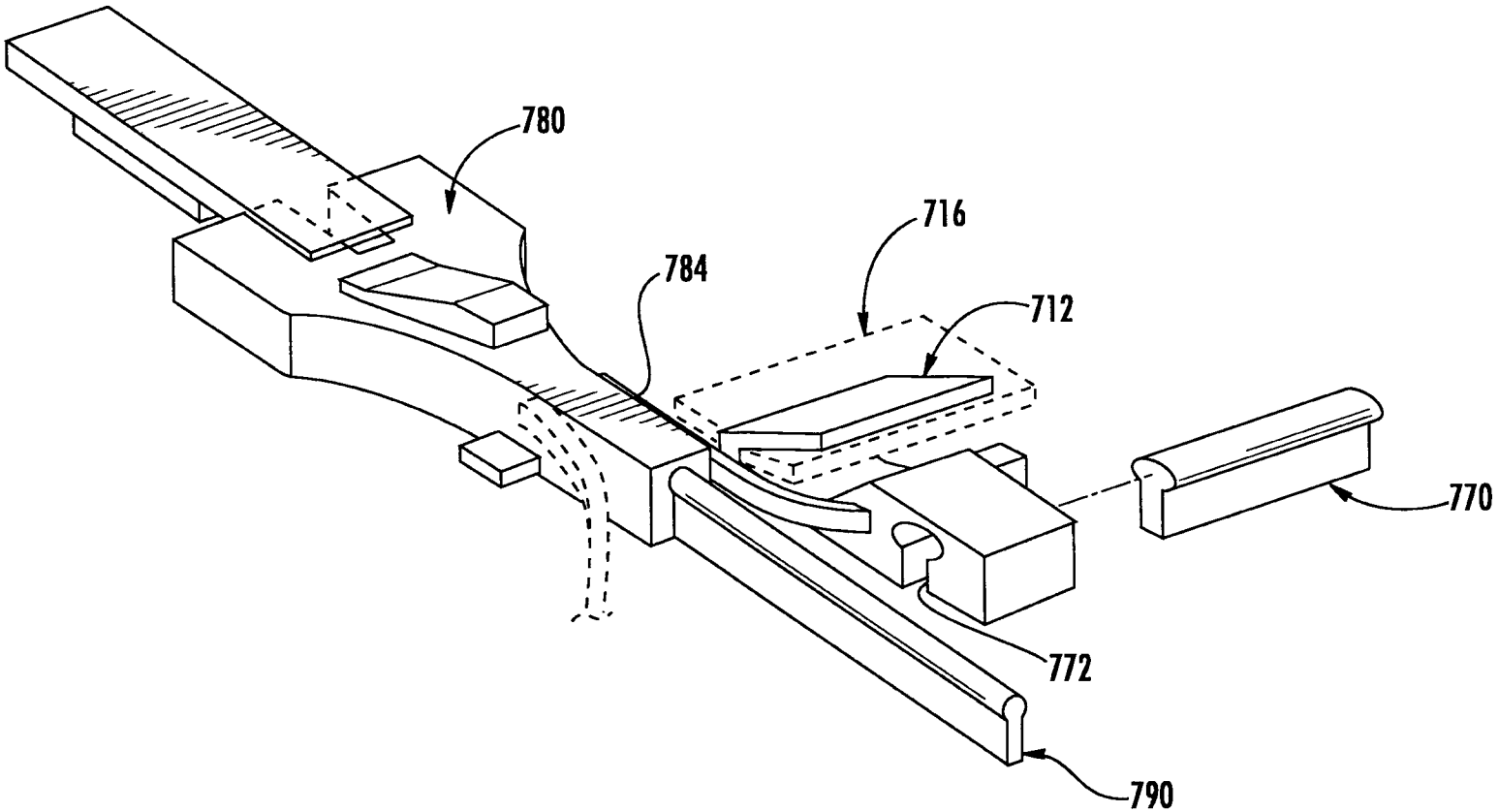
FIG. 11 is an enlarged perspective view of a variation of the buckle shown in FIG. 10 except now disposed in a ready position for a subsequent locking operation.

Reference is now had to FIGS. 10 and 11 for a description of a variation of the locking arrangement of the present invention. A buckle shown in FIG. 10, hereinafter designated as the buckle 708, comprises a pair of tenons 770, a pair of strap connecting portions 714, an entry element 710 having a pair of tang components 712, and a pair of housing elements 716. Each of the tang elements 712 of the entry element includes a groove 772 that is compatibly configured with a respective one of the tenons 770 such that the tang component 712 is slidably retained on the tenon 770 via an interlocking of the tenon 770 and the groove 772. Each strap connecting portion 714 includes a pair of strap pass-through bores 274 through which, for example, a web strap (not shown) can be passed and includes a pair of stitch flanges 776 each having a number of stitch coupling holes 778 via which the strap connecting portion 714 can be connected via stitching to a first surface (not shown) with which the buckle 708 is deployed.

The housing elements 716 are each secured via adhesive, stitching, or any other suitable securement means to a second surface (not shown) that is to be releasably secured to the first surface via the buckle 708 such that the first surface and the second surface are releasably associated in a predetermined relationship with one another across a connect interface CO-IN. A slide actuator 780 has a groove 782 via which the slide actuator is slidably mounted to a guide rib 790. The slide actuator 780 includes a pair of flex arms 784 each of which is connected to a respective one of the tang components 712. A landing flange 786 can be optionally provided at a spacing from the guide rib 790 and both the guide rib 790 and the landing flange 786 are secured to the second surface and cooperate together to guide and retain the slide actuator 780 in a stable manner. As seen in FIG. 10, the slide actuator 780 has been slid along the guide rib 790 toward the respective end thereof relatively more proximate to the tenons 770 and, as the slide actuator 780 effects this sliding motion, the flex arms 784 push the tang components 712 laterally outwardly out of the housing elements 716 to an extent that the tang components 712 are no longer in engagement with the housing elements 716, whereupon the buckle 708 is disposed in an unlocked condition. As seen in FIG. 11, which is an enlarged perspective view of a variation of the buckle shown in FIG. 10 except now disposed in a ready position for a subsequent locking operation, a sliding movement of the slide actuator 780 along the guide rib 790 away from the respective end of the guide rib 790 relatively more proximate to the tenons 770 results in an engagement of the slide actuator 780 by the landing flange 786 and a movement of the flex arms 784 such that the flex arms effect movement of the tang components 712 along the tenons 770 to respective ready positions in which the tang components are positioned for a fresh insertion into the housing elements 716 when it is desired to again the buckle 708 in its locked condition.

Figure 12:
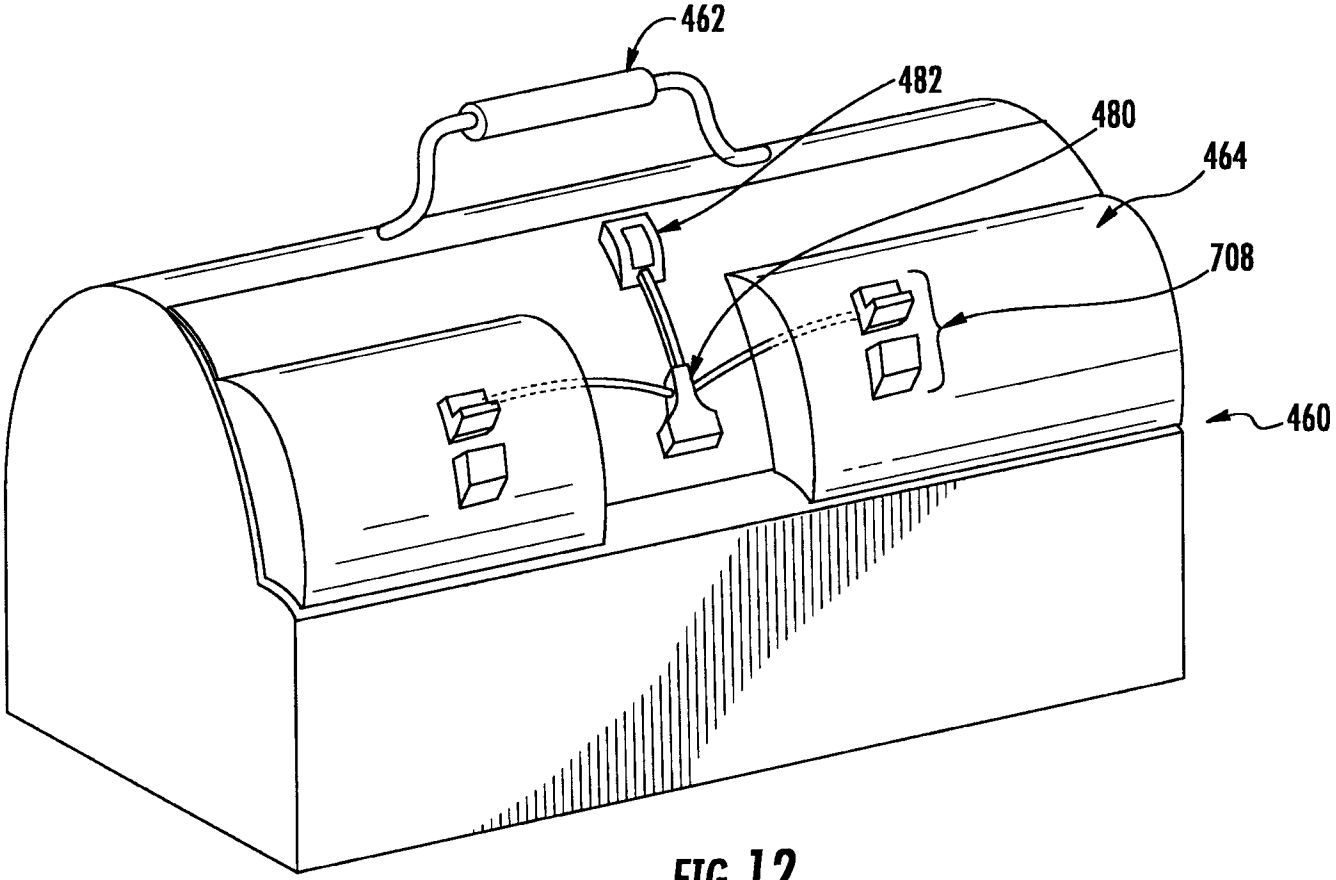
FIG. 12 is a perspective view of the buckle of the present invention, wherein multiple units of a variation of the buckle are deployed on a tote case.

Reference is now had to FIG. 12 for a description of a tote case of the present invention having multiple units of the buckle 708. A tote case 460 has an overall rectangular shape and is formed from a fabric material. The tote case 460 includes a handle 462. The tote case 560 includes sides or panels including a bottom side, opposite lateral sides, front and back sides and these sides or panels collectively delimit an open top container. A flap 464 folds over and encloses the open top of the case. A pair of the buckles 708 are deployed on the tote case 460. The housing element of each one of the pair of buckles 708 is mounted to the front side of the tote case 460 over which the flap 464 extends when the flap covers the open top of the tote case. The entry element of each one of the pair of buckles 708 is mounted to the underside of the flap 464 is alignment with a respective housing element so that the entry element and the housing element can be move into engagement with one another via, for example, the application of a force on the outer surface of the flap 464. To release the buckles 708, a single slide actuator 480 coupled to both entry elements of the buckles 708 is actuated. The slide actuator 480 can be optionally linked to a top side actuator 482 located toward the handle 462 and this top side actuator 482 can be actuated by a user in lieu of manually engaging the slide actuator 480.

Figure 13:
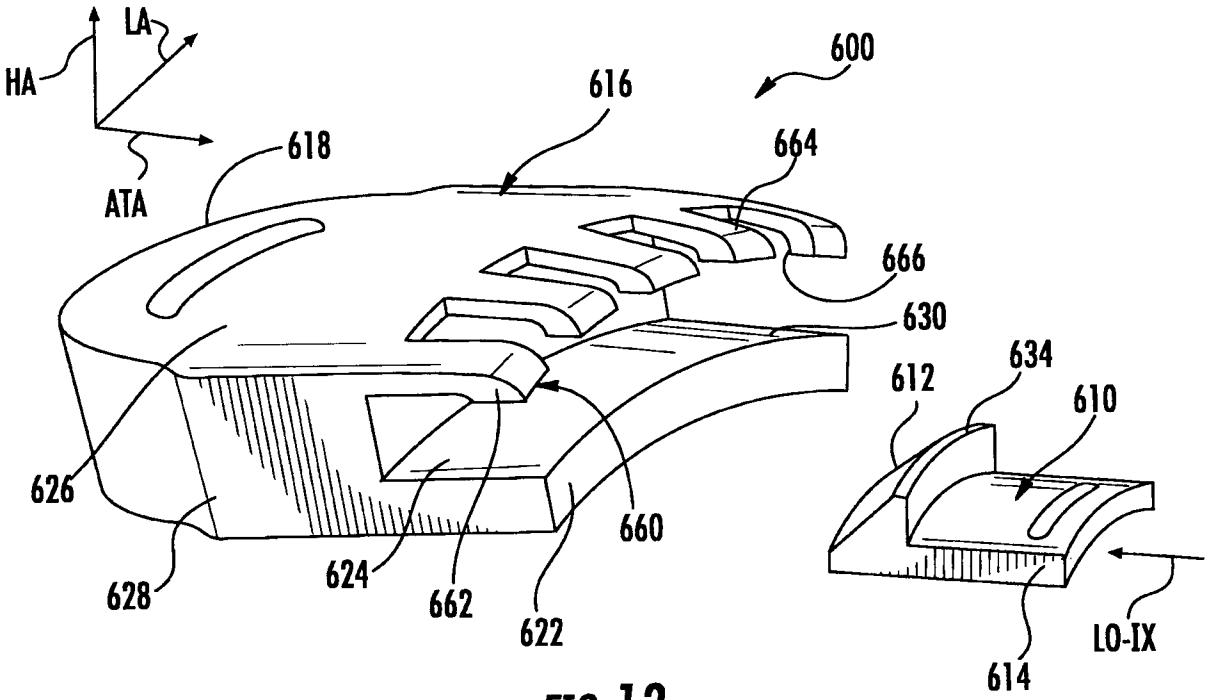
FIG. 13 is a top perspective view of a variation of the locking arrangement of the present invention in the form of a quick release buckle.

Reference is now had to FIG. 13 for a description of a variation of the locking arrangement of the present invention which is operable to releasably secure a pair of adjacent surfaces to one another. As seen in FIG. 13, which is a top perspective view of the locking arrangement of the present invention in the form of a quick release buckle, the quick release buckle, hereinafter designated as the buckle 600, is operable to releasably secure a pair of adjacent surfaces to one another and these adjacent surfaces can be, for example, surfaces formed by a pair of adjacent apparel components, surfaces formed by a pair of adjacent rigid structures, or any other pair of adjacent structures or components.

The buckle 610 includes a housing element 616 and an entry element 610. The description of the entry element 610 and the housing element 616 will be provided with reference to a three axis reference system comprised of a height axis HA, a longitudinal axis LA at ninety (90) degrees to the height axis HA, and a lateral axis ATA at ninety (90) degrees to both the height axis HA and the longitudinal axis LA. The entry element 610 includes a tang component 612 and a strap connecting component 614. The housing element 616 includes a back wall 618, a front slot wall 622, a floor 624, a ceiling wall 626, and a pair of exit side walls 628. The ceiling wall 626 includes a number of tines 660 each of which terminates in a distal end 662. Each tine 660 is spaced from any respective adjacent tine 660, as viewed in the longitudinal direction LA, such that spacing gaps 664 are formed between each respective adjacent pair of tines 660. The spacing gaps 664 extend in the depth direction ATA. The distal end 662 of each tine 660 includes a ledge surface 666 and the distal ends 662 of the tines 660 is spaced from the front slot wall 622 to thereby delimit a slot 630 therebetween.

The various walls of the housing element 616 delimit an interior volume dimensioned with respect to the tang component 612 of the entry element 610, in a manner to be described in more detail, such that the tang component 612 is received within the interior volume delimited within the housing element 616 in a lock position of the locking arrangement. The entry element 610 may be formed, for example, of a suitable plastic material, a metal material, a combination of a metal and plastic material, or any other suitable material.

The ledge surfaces 666 of the tines 660 collectively delimit a ledge interface that extends in a slight curve in the direction from one exit side wall 628 to the other exit side wall 628 and this curved ledge interface is concave as viewed in the height direction HA. The tang component 612 of the entry element 610 has a curved front profile that is configured in correspondence with the curve ledge interface delimited by the ledge surfaces 666 of the tines 660 and is thus is concave as viewed in the height direction HA. The entry element 610 is configured to be inserted through the slot 630 of the housing element 616 along a lock insertion axis LO-IX, whereupon the insertion of the entry element 610 through the slot 630 is performed in a series of steps comprising a step of orienting the tang component 612 of the entry element 610 such that the longitudinal dimension of the tang component 612 is parallel to the longitudinal direction LA and a step of advancing the entry element 610 in the locking arrangement insertion direction LO-IX such that the tang component 612 moves inwardly into the housing element 616 laterally beyond the ledge surfaces 666 of the tines 660, with the insertion of the tang component 612 ceasing once a top longitudinal edge 634 of the tang component 612 of the entry element 610 has advanced inwardly into the housing element 616 beyond the ledge interface delimited by the ledge surfaces 666 of the tines 660. It can be understood that the spacing gaps 664 permit each time 660 to be deflected in a limited manner in the height direction HA independent of adjacent tines 660 during the insertion of the tang component 612 of the entry element 610 into the housing element 616. The ledge surfaces 666 of the tines 660 engage the tang component 612 of the entry element 610 to prevent withdrawal of the entry element 610 in a direction opposite to the insertion direction LO-IX. A release of the entry element 610 from the housing element 616 is effected via a movement of the entry element 610 and the housing element 616 relative to one another in a direction following the curvature of the ledge interface delimited by the ledge surfaces 666 of the tines 660.

Figure 14:
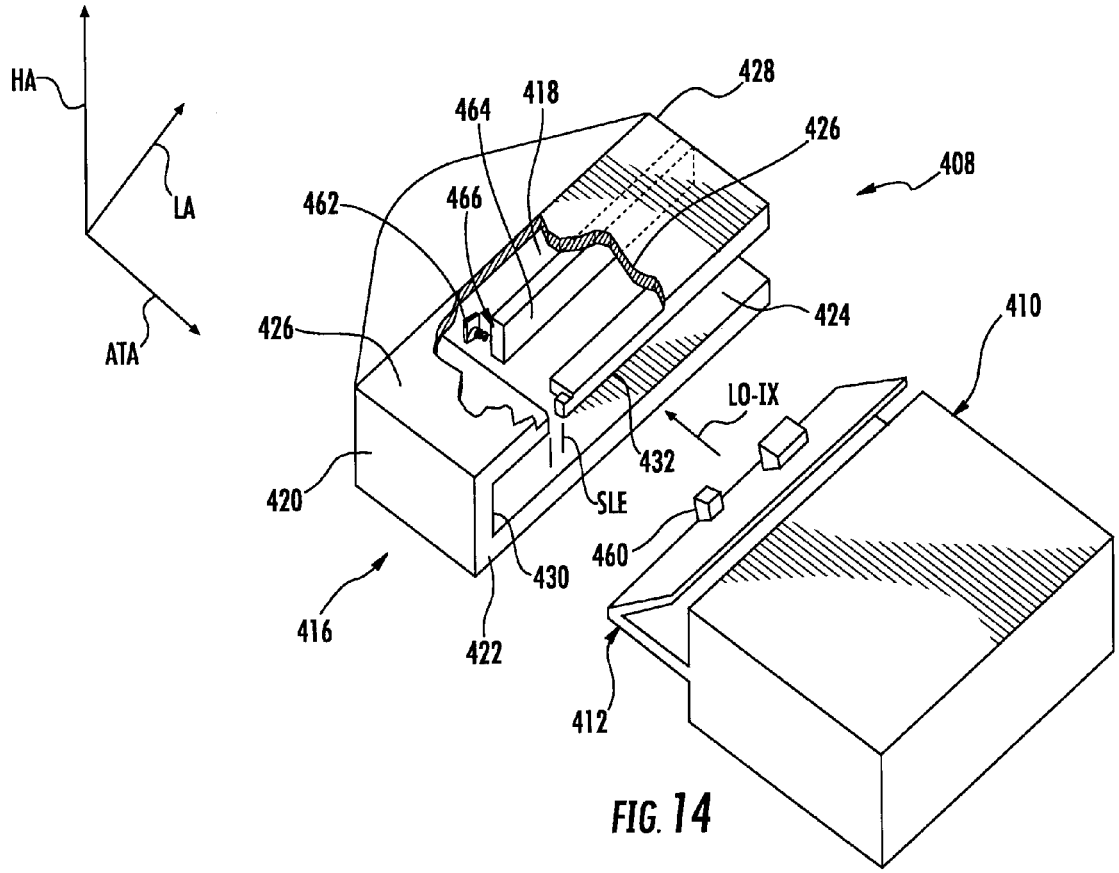
FIG. 14 is a perspective top view of one variation of the buckle in an unlocked position.

Reference is now had to FIGS. 14-17 for a description of the buckle of the present invention having a positive block feature. The locking arrangement of the present invention in this connection is exemplarily shown in the form of a quick release buckle, hereinafter generally designated as a buckle 408 and comprising a housing element 416 and an entry element 410, as seen in FIG. 14, which is a perspective top view of the buckle in an unlocked position with the housing portion and the entry portion not in fully connected engagement with one another. The entry element 410 has a tang component 412 and a strap connecting component 414. The housing element 416 includes a back wall 418, a closed side wall 420, a front slot wall 422, a floor 424, a ceiling wall 426, and an exit side wall 428. The front slot wall 422 includes a rectangular slot 430. The various walls of the housing element 416 delimit an interior volume dimensioned with respect to the tang component 412 of the entry element 410, in a manner to be described in more detail, such that the tang component 412 is received within the interior volume delimited within the housing element 416 in a lock position of the buckle. The description of the entry element 410 and the housing element 412 will be provided with reference to the three axis reference system comprised of the height axis HA, the longitudinal axis LA at ninety (90)

degrees to the height axis HA, and the lateral axis ATA at ninety (90) degrees to both the height axis HA and the longitudinal axis LA.

Figure 15:
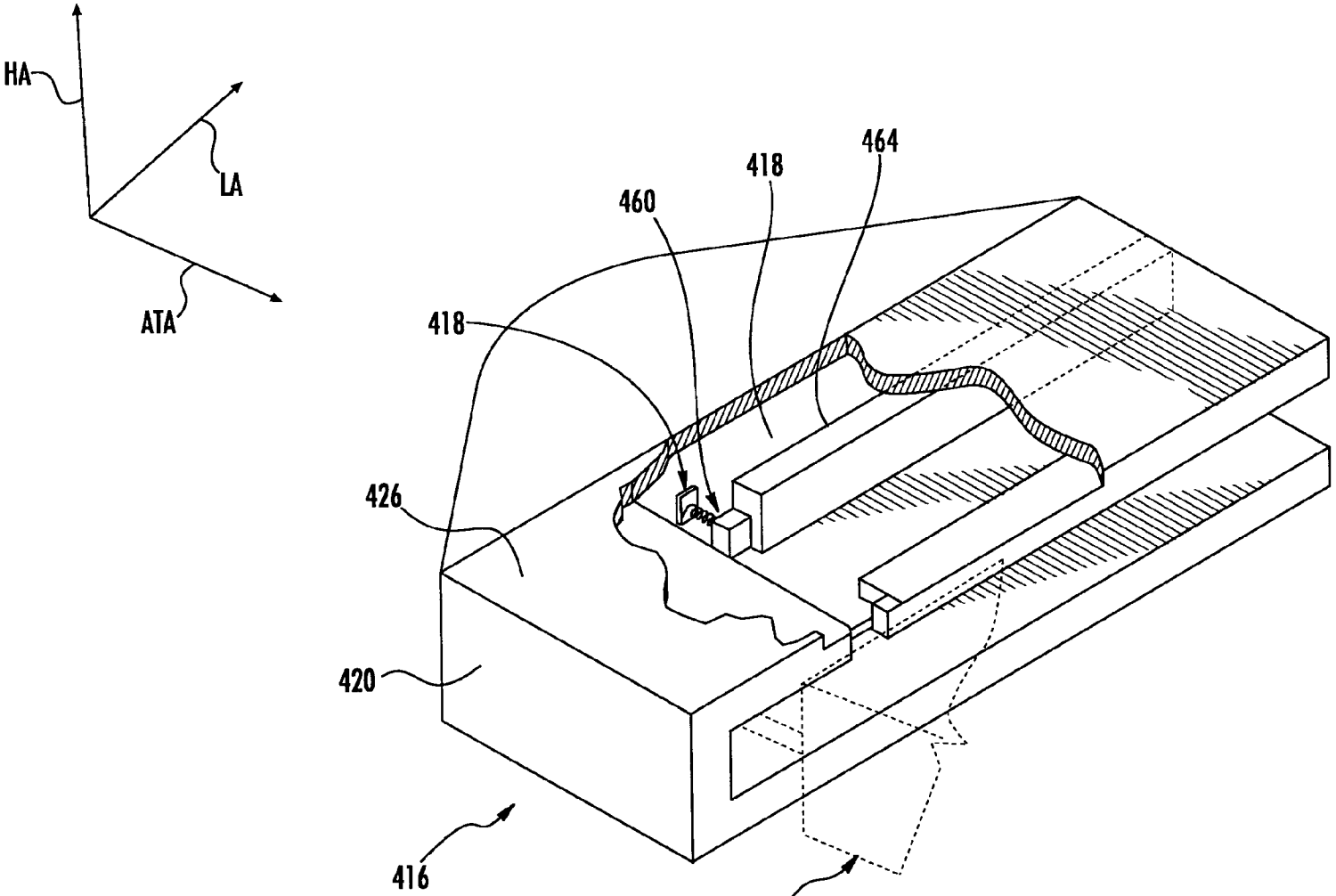
FIG. 15 is a perspective view of the buckle.

The housing element 416 also includes a stop ledge 432 that extends along the longitudinal dimension of the front slot wall 422 at a location above the slot 430 and the stop ledge 432 extends to the ceiling wall 426. The stop ledge 432 has a lateral dimension SL-E, as viewed parallel to the lateral extent of the closed side wall 420, that is less than the lateral extent of the closed side wall 420 and this lateral extent of the stop ledge 432 is configured in correspondence with the dimensions of the tang component 412 of the entry element 410 so as to engage a predetermined extent of the tang component 412. The entry element 410 and the housing element 416 operate in a manner similar to the operation of the locking arrangement described with respect to FIGS. 1-9 in that the two components can be releasably locked and unlocked to one another. As seen in FIG. 14, the entry element 410 can be moved in an insertion direction LO-X to insert its tang component 412 within the housing element 416 and, as seen in FIG. 15, which is a perspective view of the buckle 408, this insertion movement of the entry element 412 into the housing element 416 disposes the buckle 408 in its locked disposition.

As seen in FIG. 14, the buckle 408 is provided with a block tower 460 that cooperates with compatibly configured structures within the housing element 416, to be described in more detail hereinafter, to positively prevent or preclude the tang component 412 of the entry element 410 from moving outwardly from the housing element 416 in the locked disposition of the buckle 408. The block tower 460 projects from the tang component 412 of the entry element 410 and a suitable entry aperture is provided in the front slot wall 422 of the housing element 416 to permit the block tower 460 to enter the interior volume of the housing element 416 as the tang component 412 is inserted. To dispose the buckle 408 in its locked position, the tang component 412 of the entry element 410 is inserted into the housing element 416 to an extent such that the tang component will be engaged by the stop ledge 432 of the housing element 416 if an attempt is made to withdraw the tang component 412 in a direction opposite to the insertion direction and, in this locked position of the buckle 408, the block tower 460 is in an orientation relatively adjacent the back wall 418 of the housing element 416. The tang component 412, in its inserted disposition in the locked position of the buckle 408, rests against a biasing spring 462 extending inwardly from the back wall 418 of the housing element 416 and this biasing spring 462 urges the tang component 412 in a direction opposite the insertion direction LO-X such that engagement of the tang component 412 against the stop ledge 432 of the housing element 416 is assured. A ceiling rib 464 extends downwardly from the ceiling 426 of the housing element 416 and extends longitudinally toward the exit side wall 420 and has one longitudinal end that terminates at the exit side wall 428 and an opposite longitudinal end, designated as the stand off end 466, that is at a longitudinal spacing from the closed sidewall 420 of the housing element 416. Also, the ceiling rib 464 extends only partially toward the floor 424 and is thus at a height spacing from the floor 424 of the housing element 416. This height spacing, as viewed in the height direction HA, is configured such that the tang component 412 of the entry element 410 extends below the ceiling rib 464 and can freely move relative thereto without interference from the ceiling rib 464 during an unlocking movement of the entry element 410. The ceiling rib 464 is at a depth spacing from the back wall 418 and, additionally, the back wall 418 and the ceiling 464 together delimit a longitudinally extending slot having a depth spacing such that the block tower 460 projecting from the tang component 412 of the entry element 410 can move longitudinally along the slot between the ceiling rib 464 and the back wall 418 during an unlocking movement of the entry element 410.

The block tower 460 is moved into abutting engagement with the stand off end 466 of the ceiling rib 464 in the event that a force is applied to the buckle 408 that urges the tang component 412 to move laterally in the lateral direction from the closed side wall 420 toward the exit side wall 428—i.e., in the direction that the tang component 412 is moved during an unlocking movement of the entry element 410. The location of the block tower 460 on the tang component 412 is selected such that the block tower 460 is sufficiently co-extensive with the stand off end 466 of the ceiling rib 464, as viewed in the depth direction ATA, to ensure that the block tower 460 reliably abuts the ceiling rib 464 in the event of the application of such a force and does not move further in the lateral direction from the closed side wall 420 toward the exit side wall 428. The biasing action of the biasing spring 462 on the back wall 418 of the housing element 416 assists in ensuring that, the tang component 412 remains in engagement with the stop ledge 432 of the housing element 416, which is the position of the tang component 412 in which the block tower 460 at least partially co-extensive with the stand off end 466 of the ceiling rib 464 as viewed the depth direction ATA, whereupon it can be relied upon that the block tower 460 will be moved into abutting engagement with the stand off end 466 of the ceiling rib 464 in the event that a force is applied to the buckle 408 that urges the tang component 412 to move laterally in the lateral direction from the closed side wall 420 toward the exit side wall 428. As can be understood, this relative positioning of the block tower 460 and the ceiling rib 464 beneficially provides a positive yet selectively releasable securement of the tang component 412 of the entry element 410 within the housing element 416 in the locked position of the buckle 408, whereupon an inadvertent further insertion movement of the tang component 412 of the entry element 410, by itself, or an inadvertent movement of the tang component 412 in the longitudinal direction LA, by itself, will be opposed by the cooperative operation of the entry element 410 and the housing element 416.

Figure 16:
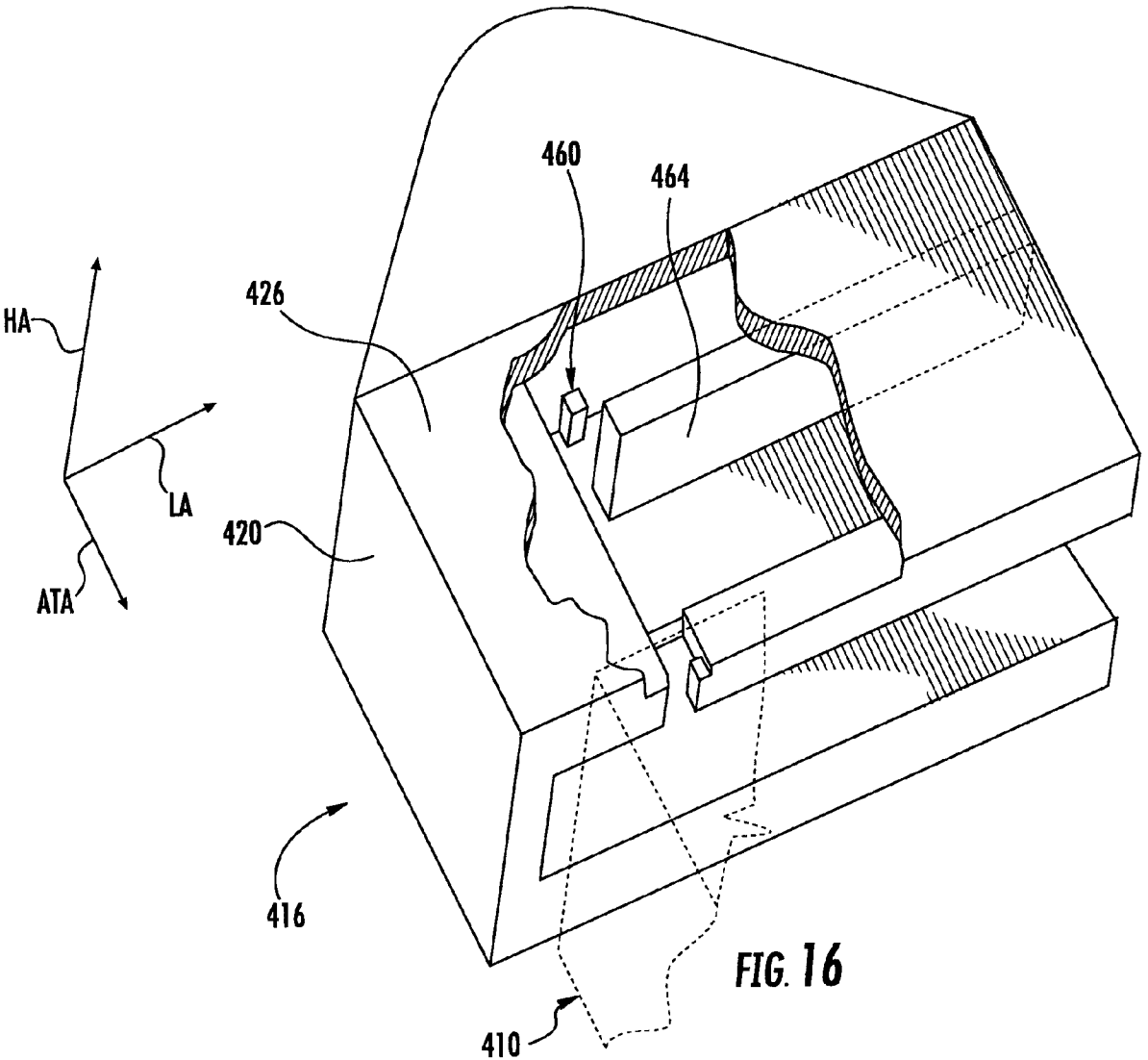
FIG. 16 is an enlarged perspective view, in partial section, of the buckle in FIG. 15 shown in its closed disposition.
Figure 17:
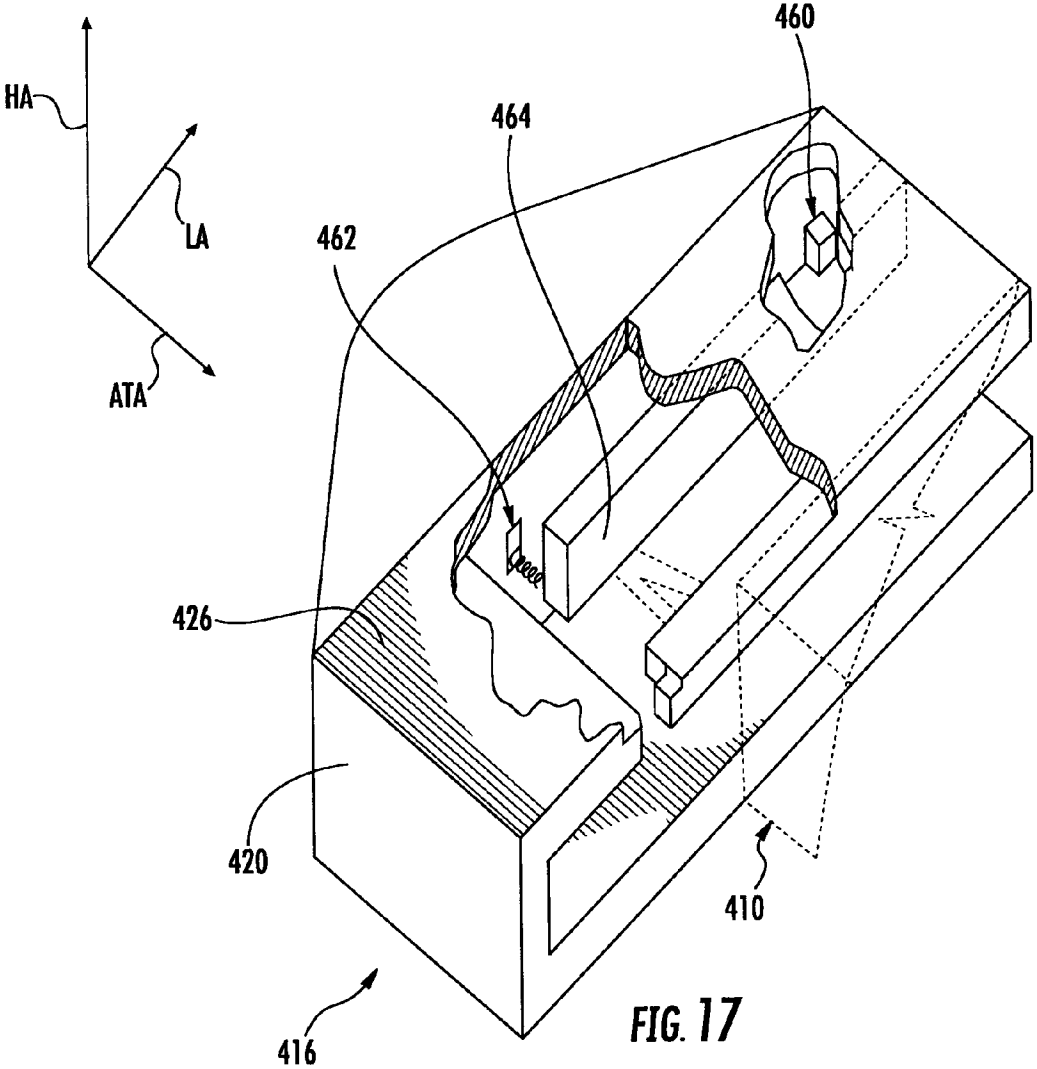
FIG. 17 is an enlarged perspective view, in partial section, of the tang component of the entry element and the housing element during an initial movement of an unlocking movement of the entry element.

As seen in FIG. 16, which is an enlarged perspective view, in partial section, of the tang component 412 of the entry element 410 and the housing element 416 during an initial movement of an unlocking movement of the entry element 410, and as seen in FIG. 17, which is an enlarged perspective view, in partial section, of a subsequent movement during the unlocking movement of the entry element 410, the configuration of the buckle 408 shown in FIGS. 14-17 permits convenient unlocking movement of the tang component 412 of the entry element 410 but only in response to an intentional movement of a user. As seen in FIG. 16, in an initial increment of an unlocking movement of the entry element 410, a user initially advances the tang component 412 in the depth direction to deflect the biasing spring 462 on the back wall 418 of the housing element 416 into a deflected position and this movement brings about a corresponding re-positioning of the block tower 460 projecting from the tang component 412 such that the block tower 460 is no longer at least partially co-extensive with the stand off end 466 of the ceiling rib 464 as viewed the depth direction ATA but is, now, as viewed in the depth direction ATA, in registry with the spacing formed between the ceiling rib 464 and the back wall 418 of the housing element 416. Accordingly, as seen in FIG. 17, to effect a subsequent increment of the unlocking movement of the entry element 410, a user can move the tang component 412 of the entry element 410 in the lateral direction from the closed side wall 420 toward the exit side wall 428, whereupon the entirety of the tang component 412 will eventually pass through and laterally beyond the slot formed in the exit side wall 428 of the housing element 416 and the buckle 408 will then be in its unlocked condition. During this subsequent increment of the unlocking movement of the entry element 410, the block tower 460 moves longitudinally along the space delimited between the ceiling rib 464 and the back wall 418 while a leading edge portion of the tang component 412 moves laterally under the ceiling rib 464.

Figure 18:
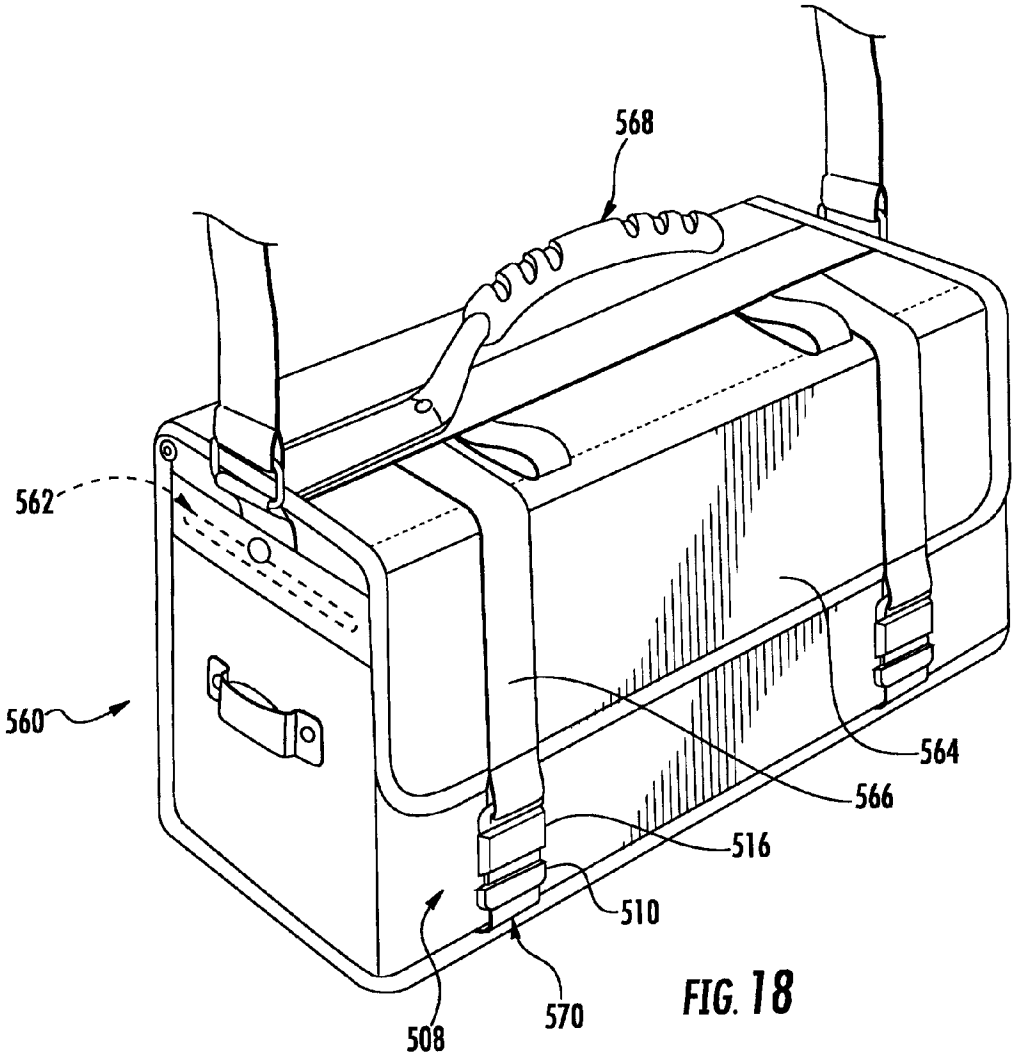
FIG. 18 is a perspective view of the buckle of the present invention, wherein multiple units of a variation of the buckle are deployed on a tote case.

Reference is now had to FIG. 18 for a description of the buckle of the present invention wherein multiple units of a variation of the buckle are deployed on a tote case. A tote case 560 has a rectangular parallelepiped shape and is formed from a fabric material. The tote case 560 includes frame wire rods 562 incorporated in the side panels of the case. The tote case 560 includes a total of five (5) sides or panels in the form of a rectangular parallelepiped including a bottom side, opposite lateral sides, front and back sides and these sides or panels collectively delimit an open top container. A top side 564 folds over and encloses the open top of the case. The sides are formed from a non-rigid fabric material and the frame wire rods 562 are disposed at or adjacent the top edge of the front and lateral side panels. Multiple units of a variation of the buckle of the present invention are deployed on the tote case 560, wherein the multiple buckle units are specifically in the form of a pair of buckles 508. Each buckle 508 is exemplarily shown in the form of a quick release buckle and has an entry element 510 and a housing element 516. The entry element 510 and the housing element 516 operate in a manner similar to the operation of the locking arrangement described with respect to FIGS. 1-9 in that the two components can be releasably locked and unlocked to one another. The housing element 516 of each one of the pair of buckles 508 is connected to a respective one of a pair of flap web strap segments 566 each of which is stitched to a handle area on which a handle 568 is mounted and is stitched to an edge region of the top side 564. The entry element 510 of each one of the pair of buckles 508 is connected to a respective one of a pair of base web strap segments 568 each of which is stitched to the bottom side of the tote case 560.

Figure 19:
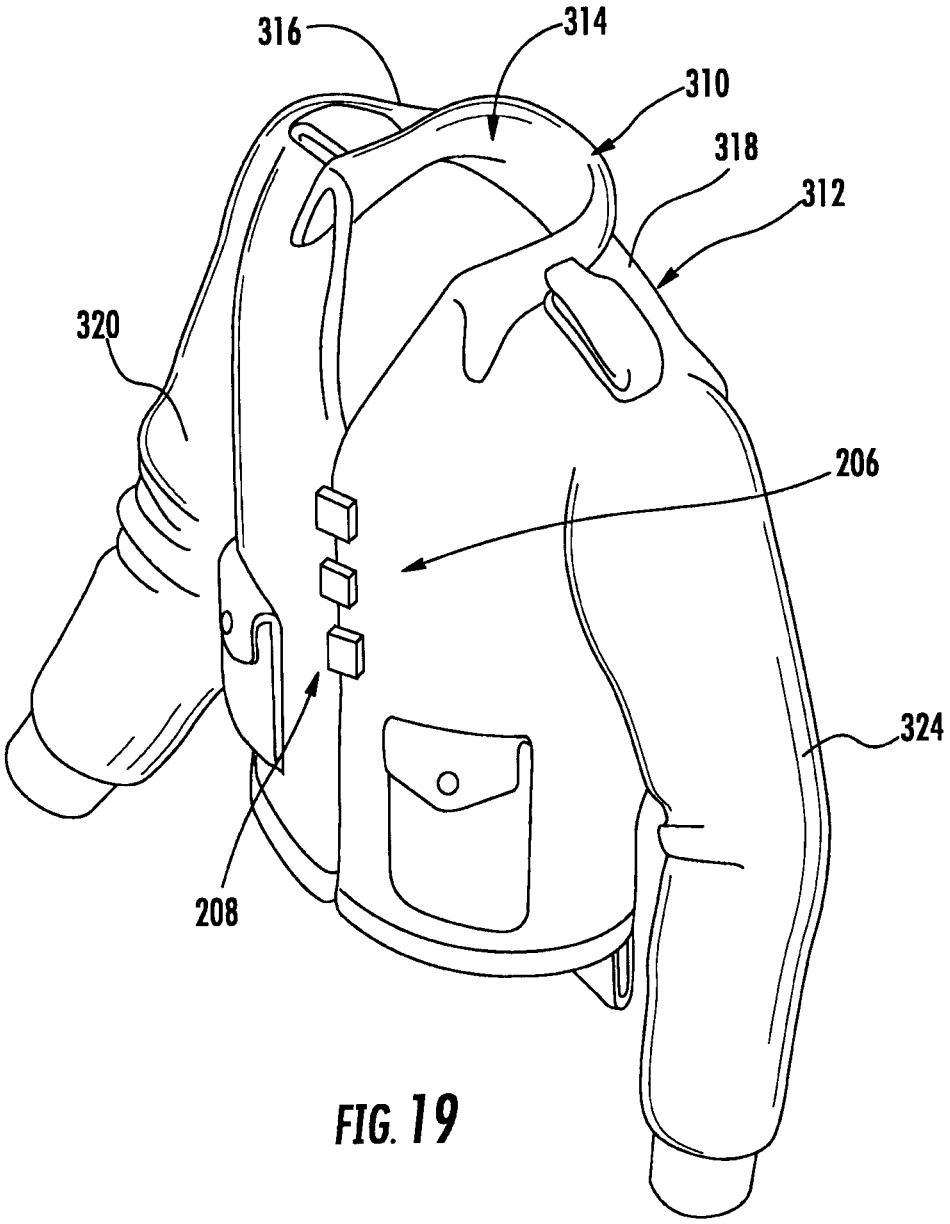
FIG. 19 is a top perspective view of a clothing jacket having the buckle rig assembly of the present invention.

Reference is now had to FIGS. 19-24 for a description of a further variation of the locking arrangement of the present invention. A buckle rig assembly, hereinafter designated as the buckle rig assembly 206, is comprised of a plurality of individual locking devices each operable to be disposed in a locking disposition and an unlocked disposition and each of these individual locking devices is referred to as a clip 208. As seen in FIG. 19, which is a top perspective view of a clothing jacket having the buckle rig assembly of the present invention, a jacket 310 is suitable for wear by a user and includes a torso-covering portion 312, a neck-accommodating section 314, two shoulder sections 316 and 318 adjacent to the neck section 314, and two sleeve sections 320 and 322 that are identical to each other and that are attached to the torso-covering portion 312 adjacent to the shoulder sections. The torso-covering portion 312 has a front closure area 324 at which a left hand lapel 326 and a right hand lapel 328 can be releasably interconnected to one another. The buckle rig assembly 206 is secured to the jacket 310 and includes a plurality of three (3) of the clips 208. In a manner described in more detail below, each of the clips 208 can be individually disposed by a wearer of the jacket 310 into its respective locked disposition to thereby interconnect the left hand lapel 326 and the right hand 328 to one another. Furthermore, the wearer of the jacket 310, or another individual, can operate the buckle rig assembly 206 release two or three of the clips 208 from their individual locked dispositions via a specific release motion that does not require that the individual separately engage each of the clips 208 to effect the release of the individual clip from its locked disposition, whereupon the left hand lapel 326 and the right hand lapel 328 are disposed so as to no longer be interconnected to one another.

The buckle rig assembly 206 is configured such that a force can be applied at a distance from a single clip 208 to effect a movement of the single clip into its unlocked disposition or, alternatively, is configured such that a force can be applied at a distance from the plurality of clips to effect a movement of at all or some of the plurality of clips from their respective unlocked dispositions in a limited release movement, coordinated manner. As seen in FIGS. 20-24, each of which is a top perspective view of one variation of an individual clip, the clip 208 has a positive block feature as has been described herein with respect the buckle shown in FIGS. 14-17. In this connection the clip 208 has a tang WEDGE that operates in a similar manner to the entry element 416 of the buckle 408 and a garage PORT that operates in a similar manner to the housing element 416 of the buckle 408. The tang WEDGE has a tang rail T-RAIL and the garage PORT has a garage rail GR-AIL.

The clip 208 includes a travel cart 210 having a left hand side wall 212 and a right hand side wall 214 connected to one another via a bridge wall 216. A tunnel entrance wall TUN-ENT has an edge connected to the bridge wall 216, an edge connected to the left hand side wall 21, and an edge connected to the right hand side wall 214. The tunnel entrance wall TUN-ENT delimits a circular entrance ENT-AA having a radial centerpoint and a circular entrance ENT-BB having a radial centerpoint. The circular entrance ENT-AA is configured to receive therethrough the Tang rail T-RAIL during movement of the travel cart 210 relative to the Tang rail T-RAIL and the circular entrance ENT-BB is configured to receive therethrough the garage rail GR-AIL during movement of the travel cart 210 relative to the garage rail GR-AIL.

The left hand side wall 212, the right hand side wall 214, and the bridge wall 216 together delimit a pass through volume 218 and this pass through volume 218 is compatibly configured with respect to the pair of rails tang rail T-RAIL and garage rail GR-AIL, in a manner described in more detail below, such that the travel cart 210, during an initial release movement, constrains the tang rail T-RAIL and the garage rail GR-AIL to move relative to one another in a manner that disposes the Tang WEDGE in a ready drop disposition relative to the Garage PORT and such that the travel cart 210, during a final clear out movement, moves the tang WEDGE from its ready drop disposition to a complete eject disposition in which the tang WEDGE is no longer coupled with the Garage, whereupon the tang WEDGE and the garage PORT are no longer in their interlocked disposition. Reference is had a plurality of reference axes shown in FIG. 20 comprised of a longitudinal axis LON-G and a lateral axis LAT.

Figure 20:
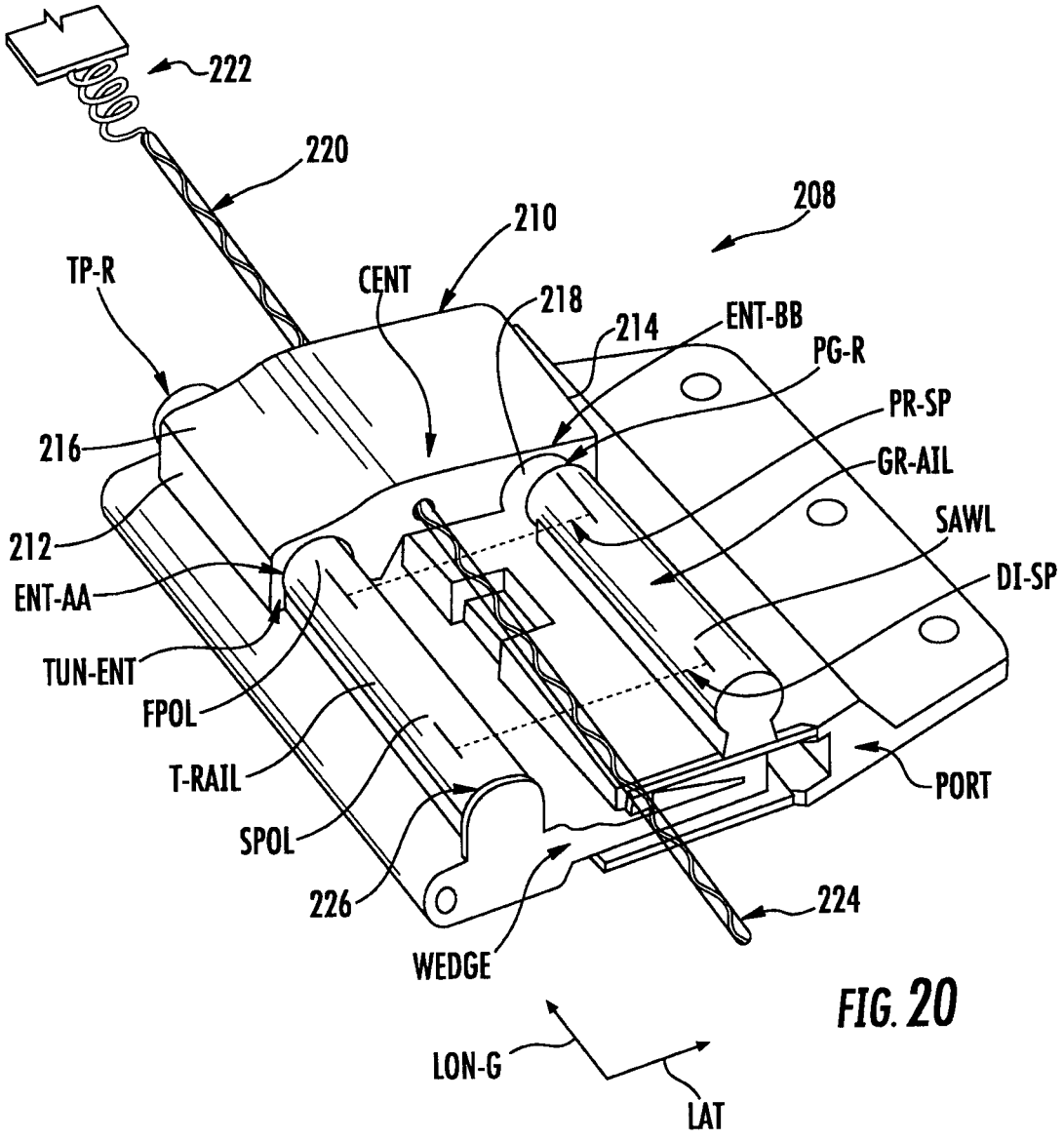
FIG. 20 is a top perspective view of one variation of an individual clip.

The tang rail T-RAIL has a proximate end TP-R and a distal end. The garage rail GR-AIL has a proximate end PG-R and a distal end. As seen in FIG. 20, an upstream cable 220 has one end connected to the bridge wall 216 of the travel cart 210 and an opposite axial end of the upstream cable 220 is connected to a reset assembly 222. A downstream cable 224 has one end connected to the bridge wall 216 of the travel cart 210 and an opposite axial end of the downstream cable 224 is connected to the bridge wall of a travel cart of another clip. The tang rail T-RAIL of the tang WEDGE is configured relative to the garage rail GR-AIL of the garage PORT such that, in the coupled disposition of the clip in which the tang WEDGE has been releasably secured in the garage, the proximate end TP-R of the tang rail T-RAIL of the tang WEDGE extends further in an upstream direction parallel to the longitudinal axis LON-G than the proximate end of the garage rail GR-AIL PG-R of the garage. The travel cart 210 is positionable in a home base position, shown in FIG. 20, in which the travel cart 210 receives a portion of the tang rail T-RAIL of the tang WEDGE within the pass through volume 218 in a manner such that the distal end of the tang rail T-RAIL is not received in the pass through volume 218 and, additionally, none of the garage rail GR-AIL is received in the pass through volume 218. This home position of the travel cart 210 is achieved via disposing in its releasably secured disposition in the garage. The proximate end TP-R of the tang rail T-RAIL of the tang WEDGE extends further in the upstream direction than the proximate end of the garage rail GR-AIL PG-R of the garage PORT in the coupled disposition of the clip in which the tang WEDGE has been releasably secured in the garage. The extent to which the proximate end TP-R of the tang rail T-RAIL of the tang WEDGE extends further in the upstream direction than the proximate end of the garage rail GR-AIL PG-R of the garage PORT in the coupled disposition of the clip in which the tang WEDGE has been releasably secured in the garage, and the dimensions of the travel cart 210, are selected such that the travel cart 210, when positioned in its home base position in which the travel cart 210 receives a portion of the tang rail T-RAIL of the tang WEDGE within the pass through volume 218, is out of interference with the garage PORT of the clip during movement of the tang WEDGE into the garage, including being out of interference with the garage rail GR-AIL.

The circular entrance ENT-AA has a radius of at least one hundred and eighty degrees and that is compatibly configured with respect to the cylindrical extent of the tang rail T-RAIL to partially encircle the tang rail T-RAIL when the tang WEDGE rail is received in the pass through volume 218. The circular entrance ENT-BB has a radius of at least one hundred and eighty degrees and that is compatibly configured with respect to the cylindrical extent of the garage rail GR-AIL to partially encircle the garage rail GR-AIL when the garage rail GR-AIL is received in the pass through volume 218.

The reset assembly 222 is operable to automatically return the travel cart 210 to its home base position after each cycle pair of an initial release movement and a final clear out movement of the travel cart 210 and, moreover, the reset assembly 222 maintains the travel cart 210 in its home base position until another cycle pair of an initial release movement and a final clear out movement of the travel cart 210 is performed.

With further reference to FIG. 20, while the travel cart 210 in its home base position is out of interference with the garage PORT of the clip during movement of the tang WEDGE into the garage, the pass through volume 218 of the travel cart 210 comes into alignment with the garage rail GR-AIL of the garage PORT as the tang WEDGE completes its movement into its releasably secured disposition with the garage. Specifically, the alignment of the pass through volume 218 of the travel cart 210 with the garage rail GR-AIL of the garage PORT is configured such that, upon a first portion of movement of the travel cart 210 during its initial release movement in which the travel cart 210 is moved in the downstream direction opposite to the upstream direction, the garage rail GR-AIL of the garage PORT enters the pass through volume 218, whereupon both the tang rail T-RAIL of the tang WEDGE and the garage rail GR-AIL of the garage PORT are now received in the pass through volume 218 of the travel cart 210.

Figure 21:
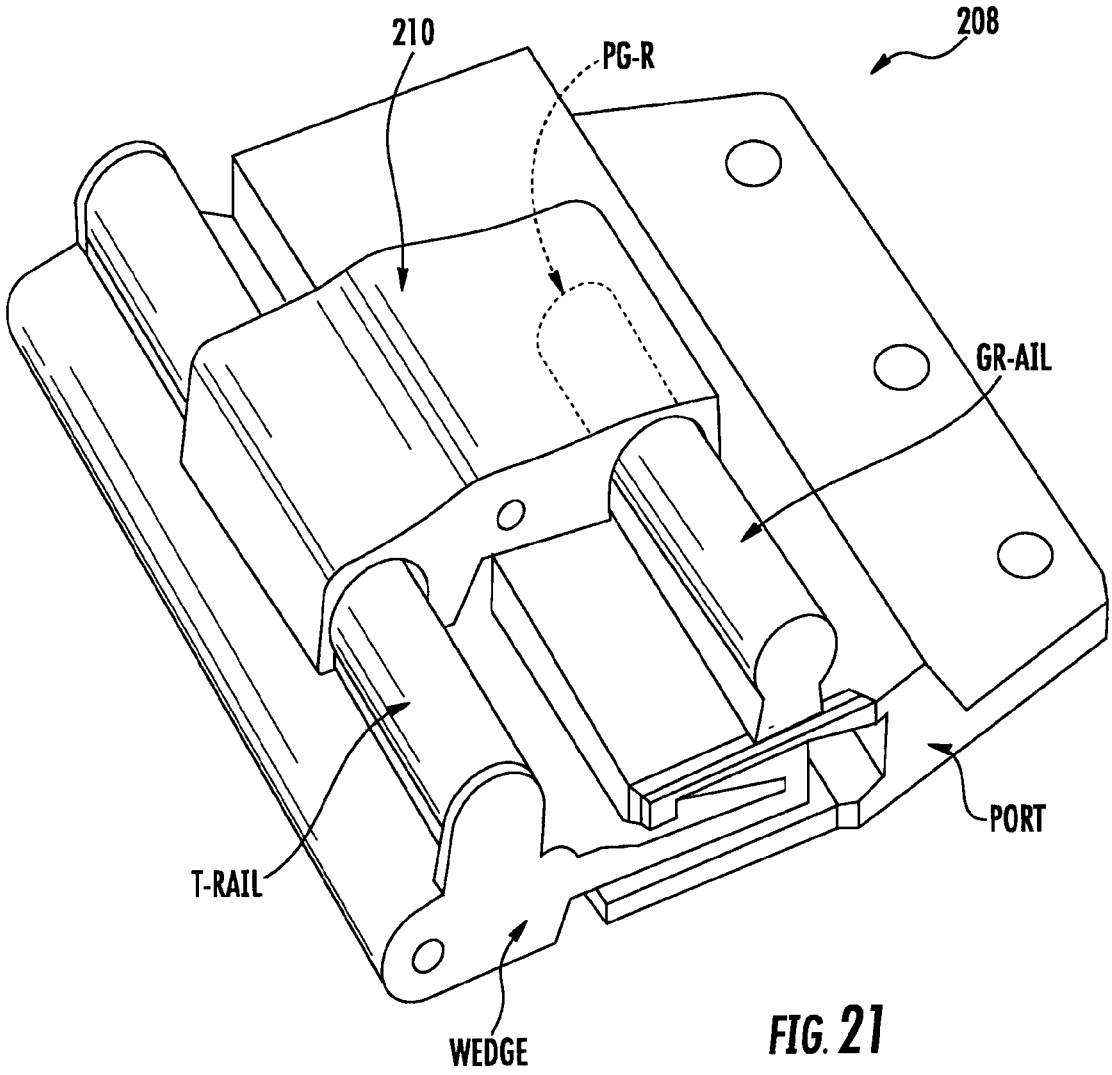
FIG. 21 is a top perspective view of one variation of an individual clip.

With reference now to FIG. 21, to initiate the initial release movement of the travel cart 210, a force is the downstream direction is applied on the downstream cable 224 and this force can be applied, for example, via manual engagement of the downstream cable by a user or via a movement in the downstream direction of the other clip to which the downstream cable is attached. The downstream cable 224 under the application of this downstream force effects advancing movement, of the travel cart 210 along the tang rail T-RAIL of the tang WEDGE out of its home base position. This advancing movement of the travel cart 210, which is exemplarily shown as being a sliding movement of the travel cart 210, results in movement of the travel cart 210 relatively along the garage rail GR-AIL of the garage PORT with the garage rail GR-AIL being received in the pass through volume 218 of the travel cart 210 and this can be seen in FIG. 21 in which the proximate end PG-R of the garage rail GR-AIL is received in the pass through volume 218 of the travel cart 210. The initial release movement of the travel cart 210 constrains the Tang rail T-RAIL and the garage rail GR-AIL to move relative to one another in a manner that disposes the tang WEDGE in a ready drop disposition relative to the garage PORT. Specifically, as the travel cart 210 slides relatively along the tang rail T-RAIL of the tang WEDGE and the garage rail GR-AIL of the garage PORT with both respective rails received in the pass through volume 218 of the travel cart 210, the tang rail T-RAIL of the tang WEDGE and the garage rail GR-AIL of the garage PORT move relatively toward one another in a rail transverse parallel to the lateral axis LAT (i.e., a direction perpendicular to the upstream direction). This relative movement of the tang rail T-RAIL of the tang WEDGE and the garage rail GR-AIL of the garage PORT toward one another in the rail transverse direction can be achieved, for example, via configuring the travel cart 210, the tang rail T-RAIL of the tang, and the garage rail GR-AIL of the garage PORT relative to one another in a predetermined manner. For example, in one exemplary predetermined coordinated configuration of the travel cart 210 and as seen in FIG. 20, the tang rail T-RAIL of the tang, and the garage rail GR-AIL of the garage: (a) the proximate end of the garage rail GR-AIL PG-R of the garage PORT and a first pick-off location FPOL on the tang rail T-RAIL of the tang WEDGE located co-axially with the proximate end PG-R of the garage rail GR-AIL of the garage PORT in the releasably secured position of the tang WEDGE and the garage PORT are at an upstream transverse spacing PR-SP, as viewed in the rail transverse direction; (b) a spaced away location SAWL on the garage rail GR-AIL of the garage PORT spaced from the proximate end of the garage rail GR-AIL PG-R and a second pick-off location SPOL on the tang rail T-RAIL of the tang WEDGE located co-axially with the spaced away location of the garage rail GR-AIL of the garage PORT in the releasably secured position of the tang WEDGE and the garage PORT are at a downstream transverse spacing DI-SP that is greater than the upstream transverse spacing PR-SP, and (c) the spacing CENT between the radial centers of the circular entrance ENT-AA and the circular entrance ENT-BB, as measured in the rail transverse direction, is compatibly configured with respect to the upstream transverse spacing PR-SP between the first pick-off location FPOL of the tang rail T-RAIL of the tang WEDGE and the proximate end of the garage rail GR-AIL PG-R of the garage PORT to permit the travel cart 210 to slide with both the tang rail T-RAIL of the tang WEDGE and the garage rail GR-AIL of the garage PORT received in the pass through volume 218; and (d) the spacing CENT between the radial centers of the circular entrance ENT-AA and the circular entrance ENT-BB, as measured in the rail transverse direction, is less than the downstream transverse spacing DI-SP between the second pick-off location SPOL of the tang rail T-RAIL of the tang WEDGE and the spaced away location SAWL of the garage rail GR-AIL of the garage. Consequently, when the travel cart 210 advances from its home base position during the initial release movement, the travel cart 210 slides along the tang rail T-RAIL of the tang WEDGE with only the tang rail T-RAIL received in the pass through volume 218, thereafter slides past the first pick-off location FPOL of the tang rail T-RAIL of the tang WEDGE and the proximate end of the garage rail GR-AIL PG-R of the garage, and thereafter continues to slide along both the tang rail T-RAIL of the tang WEDGE and the garage rail GR-AIL of the garage PORT with both the tang rail T-RAIL of the tang WEDGE and the garage rail GR-AIL of the garage PORT being received in the pass through volume 218. As the travel cart 210 continues to slide along both the tang rail T-RAIL of the tang WEDGE and the garage rail GR-AIL of the garage, the travel cart 210 constrains the tang rail T-RAIL of the tang WEDGE and the garage rail GR-AIL of the garage PORT to move toward one another relative to the rail transverse direction by virtue of the fact that the spacing CENT between the radial centers of the circular entrance ENT-AA and the circular entrance ENT-BB is less than the downstream transverse spacing DI-SP between the second pick-off location SPOL of the tang rail T-RAIL of the tang WEDGE and the spaced away location SAWL of the garage rail GR-AIL of the garage.

Figure 22:
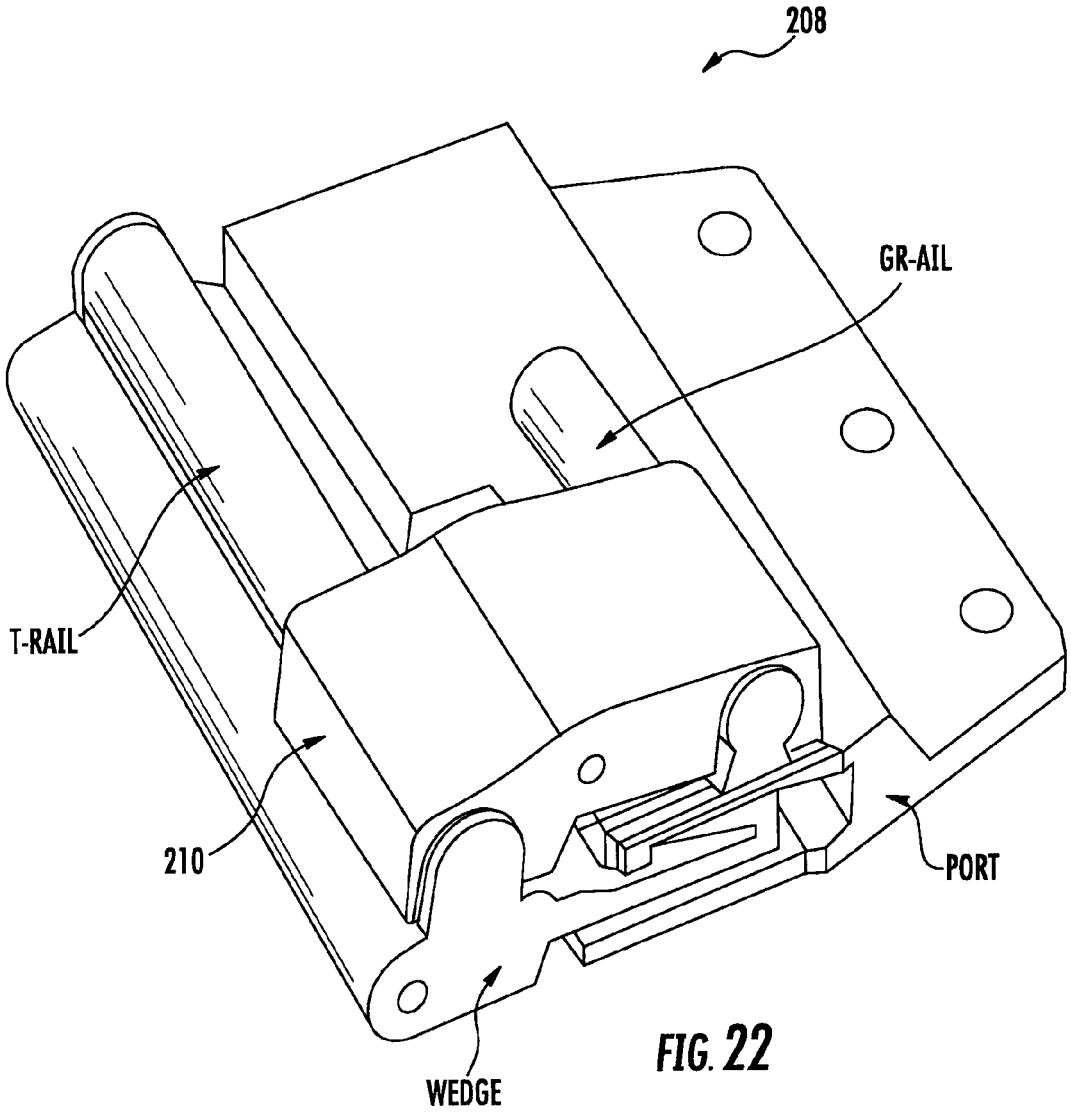
FIG. 22 is a top perspective view of one variation of an individual clip.
Figure 23:
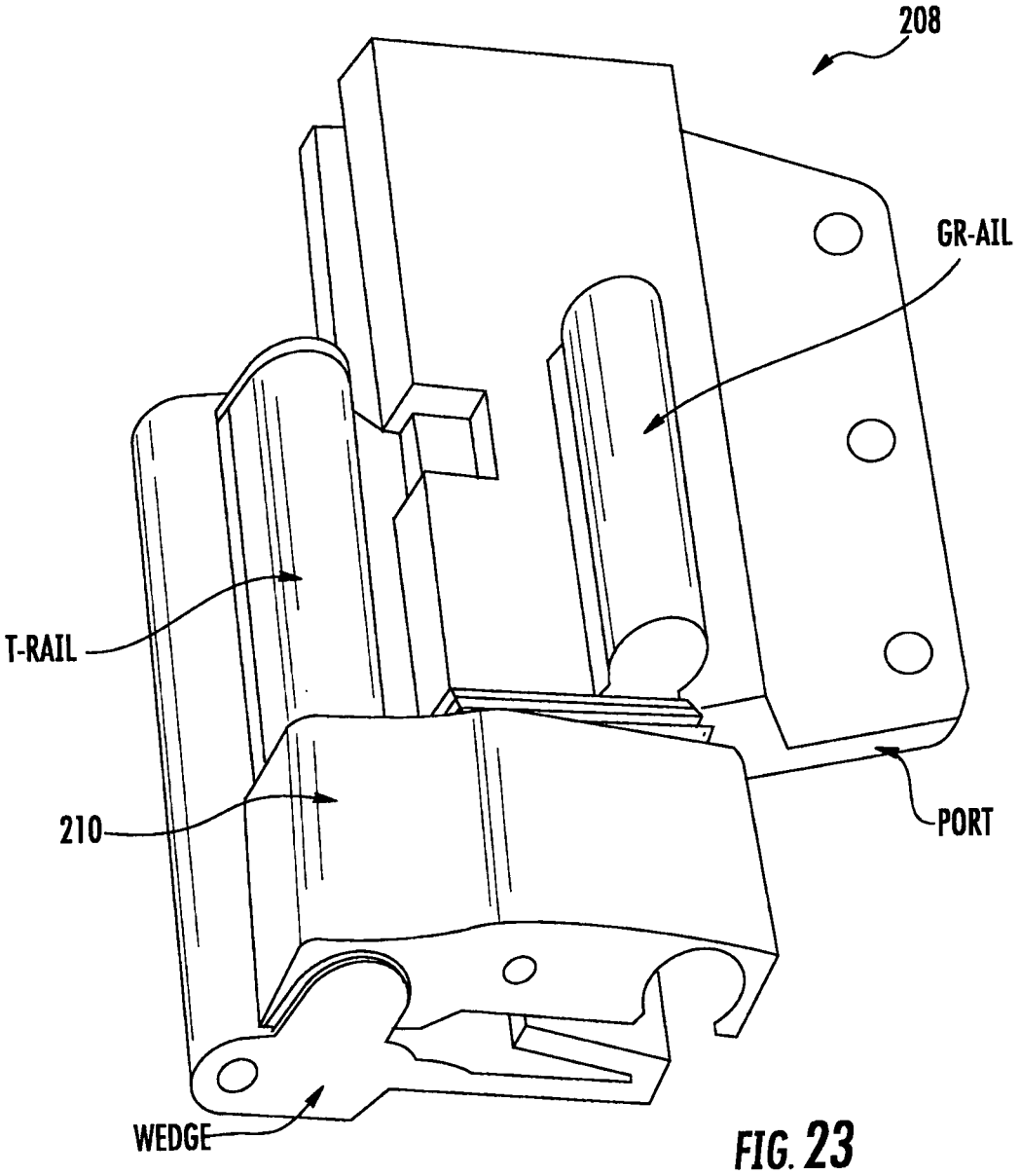
FIG. 23 is a top perspective view of one variation of an individual clip.
Figure 24:
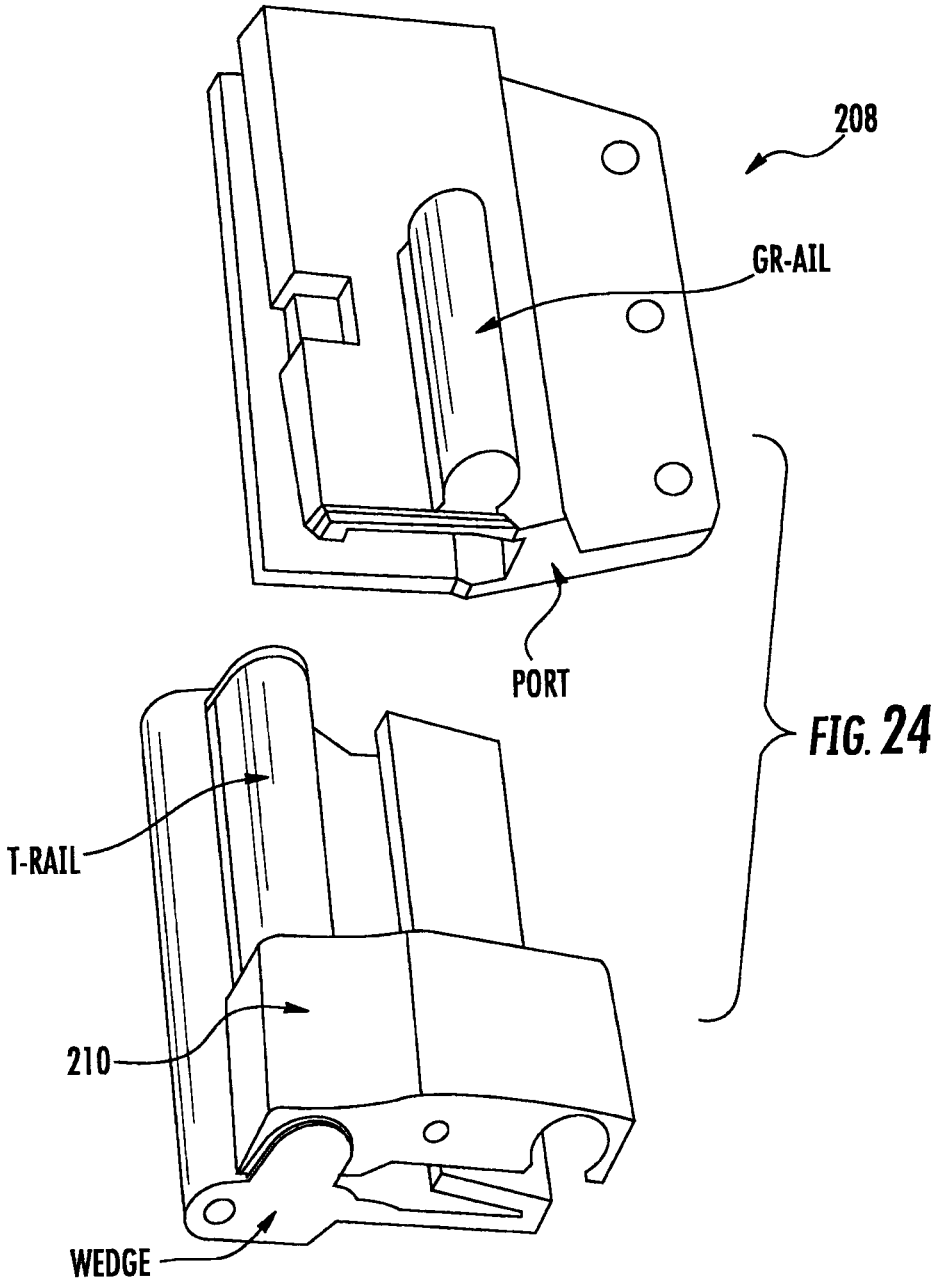
FIG. 24 is a top perspective view of one variation of an individual clip.

The movement of the tang rail T-RAIL of the tang WEDGE and the garage rail GR-AIL of the garage PORT toward one another in the rail transverse direction effects movement of the tang WEDGE into its ready drop disposition relative to the Garage. The distal end of the tang rail T-RAIL of the tang WEDGE includes a collar 226 having a larger diameter than the remainder of the garage rail GR-AIL, which is of a uniform nominal diameter, and the diameter of the collar 226 of the tang rail T-RAIL of the tang WEDGE is compatibly configured with respect to the travel cart 210 such that the collar 226 prevents the travel cart 210 from further downstream sliding movement along the tang rail T-RAIL of the tang WEDGE once the travel cart 210 has contacted the collar 226. In contrast, the garage rail GR-AIL of the garage PORT has a uniform nominal diameter along its entire length and offers no resistance of any import to the sliding movement of the travel cart 210 along the entire length of the garage rail GR-AIL. FIG. 22 shows a period during the movement of the travel cart 210 at which the travel cart 210 has nearly reached, but not yet reached, the collar 226 of the tang rail T-RAIL of the tang WEDGE. Accordingly, during the final clear out movement, the continued advancing movement of the travel cart 210 results in the travel cart 210 moving axially beyond the distal end of the garage rail GR-AIL of the garage PORT while the travel cart 210, at the same time, is in contact with the collar 226 of the tang rail T-RAIL of the tang WEDGE and thus moves the tang WEDGE in the downstream direction relative to the garage PORT. FIG. 23 shows a period during the movement of the travel cart 210 at which the travel cart 210 has engaged the collar 226 of the tang rail T-RAIL of the tang WEDGE and has moved the tang WEDGE in the downstream direction relative to the garage PORT. The movement of the tang WEDGE completely axially beyond the garage PORT places the tang WEDGE in the complete eject disposition in which the tang WEDGE is no longer coupled with the garage PORT, whereupon the tang WEDGE and the garage PORT are no longer in their interlocked disposition and this disposition of the tang WEDGE and the garage PORT is shown in FIG. 24.

The relationship between the downstream transverse spacing DI-SP and the upstream transverse spacing PR-SP in which the downstream transverse spacing DI-SP is greater than the upstream transverse spacing PR-SP can be realized via one of several configurations. For example, the garage rail GR-AIL of the garage PORT can extend parallel to the upstream direction when the tang WEDGE is in its releasably secured disposition with the garage PORT while the tang rail T-RAIL of the tang WEDGE extends in a non-parallel orientation to the upstream direction. Alternatively, both the garage rail GR-AIL of the garage PORT and the tang rail T-RAIL of the tang WEDGE can extend in respective non-parallel orientations to the upstream direction with the proximate ends of the tang rail T-RAIL and the garage rail GR-AIL being closer to one another as viewed in the rail transverse direction than the distal ends of the tang rail T-RAIL and the garage rail GR-AIL are to one another.

As noted, several units of the clip 208 can be interconnected to one another such that, instead of the necessity of individually releasing each of the clips of the buckle rig assembly from their releasably secured dispositions, all of the buckle rig clips can be released with a limited number of release movement steps including, for example, a release movement step of applying a pulling force on an end of a cord that is serially connected to the buckle rig clips. One possible version of such a configuration involving a limited number of release movement steps is configured to release the buckle rig clips in a staggered manner with one of the buckle rig clips being disposed in the complete eject disposition in which its tang WEDGE is no longer coupled with its garage PORT before any of the other buckle rig clips are disposed in their complete eject dispositions, therein followed by another of the buckle rig clips being disposed in the complete eject disposition before any of the remaining still-secured buckle rig clips are disposed in their complete eject dispositions, and so on in a similar manner. This staggered release of the buckle rig clips can be achieved, for example, via varying the length of the tang rail T-RAIL, the garage rail GR-AIL, or both the tang rail T-RAIL and the garage rail GR-AIL, of each of the buckle rig units relative to the tang rail T-RAIL s or the garage rail GR-AIL of the other buckle rig clips. In this manner, the travel cart 210 of each respective buckle rig clip 208 moves axially beyond the distal end of the garage rail GR-AIL of its garage PORT at a different time than the travel carts of the other buckle rig clips move axially beyond the distal end of their garage rail GR-AIL.

Figure 25:
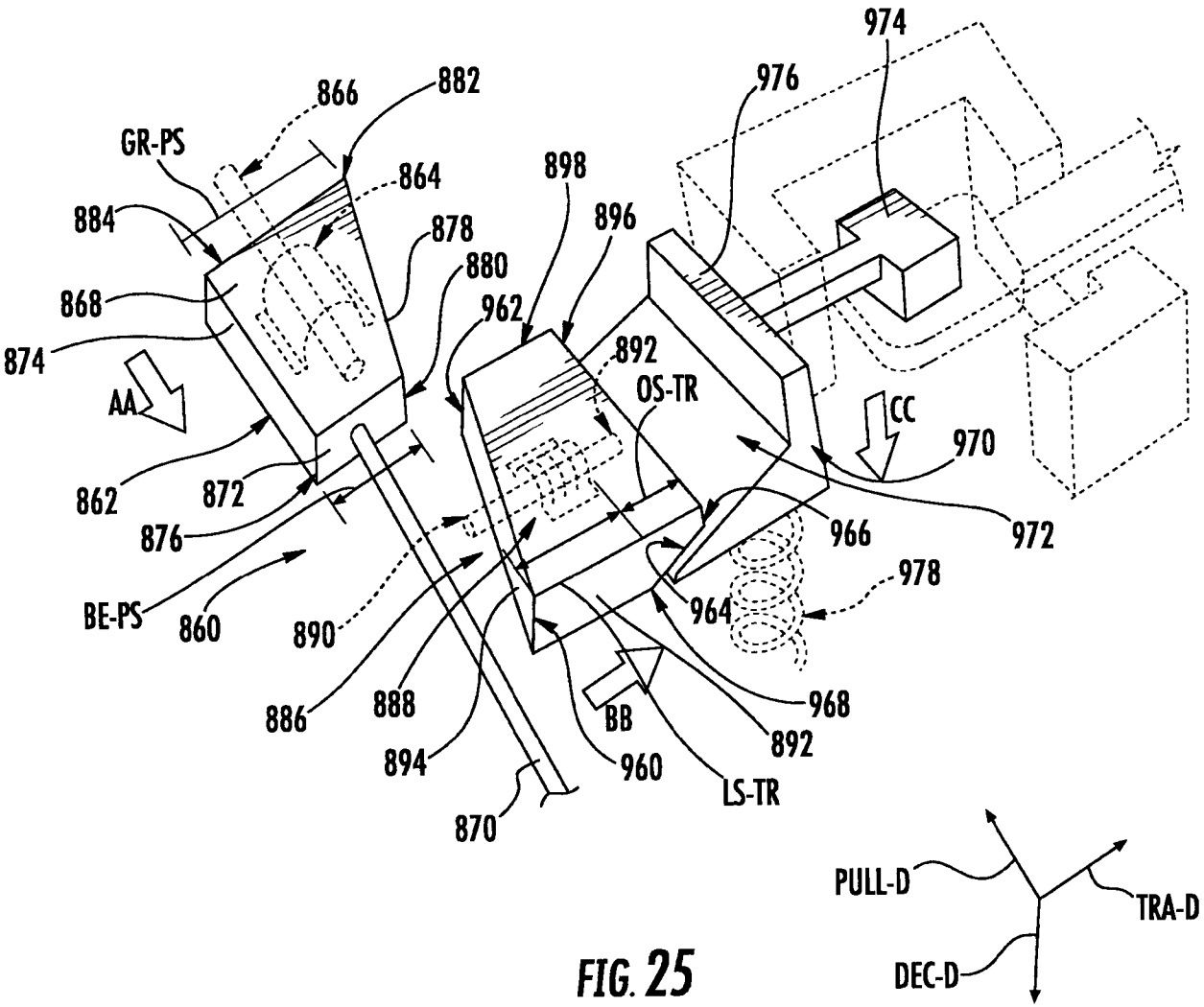
FIG. 25 is a top perspective view of another variation of the locking arrangement of the present invention.

Reference is now had to FIG. 25, which is a top perspective view of another variation of the locking arrangement of the present invention. A buckle rig assembly, hereinafter designated as the buckle rig assembly 830, is comprised of a plurality of individual locking devices each operable to be disposed in a locking disposition and an unlocked disposition and each of these individual locking devices is referred to as a lock module. The buckle rig assembly 830 is configured such that a force can be applied at a distance from a single lock module to effect a movement of the single lock module into its unlocked disposition or alternatively, is configured such that a force can be applied at a distance from the plurality of clips to effect a movement of at all or some of the plurality of lock modules from their respective unlocked dispositions in a limited release movement, coordinated manner. The buckle rig assembly 830 includes a number of lock modules that can be operatively connected to one another and a description will now be provided of a single lock module, it being understood that the lock modules can be identically or similarly configured. A remote force transmitting assembly 860 having a slider wedge 862 that is operatively coupled via a bore tunnel 864 with a rail guide 866. The bore tunnel 864 is secured to a top surface 868 of the slider wedge 862 via an adhesive securement or is alternatively integrally formed with the slider wedge 862 and the bore tunnel 864 include an aperture through the rail guide 866 extends. The rail guide 866 has a pair of opposed ends (not shown) that are each secured to a mounting surface such as, for example, a mounting surface in the form of the outer surface of a garment such as, for example, a vest. By virtue of the operative relationship of the bore tunnel 864 and the rail guide 866, the slider wedge 862 can be moved in a direction parallel to the rail guide 866 such as, for example, in a remote pull direction AA shown in FIG. 30. The longitudinal extend of the rail guide 866 extends in a pull axis PULL-D, which one of the three axes of a three axis reference system comprised of the pull axis PULL-D, a transfer axis TRA-D at ninety (90) degrees to the pull axis PULL-D, and a decouple axis DEC-D at ninety (90) degrees to both the pull axis PULL-D and the transfer axis TRA-D.

The remote force transmitting assembly 860 includes a pull cord 870 having one end fixedly secured to a left cap surface 872 of the slider wedge 862 and an opposite end having a gripping configuration (not shown) configured for convenient gripping of the opposite end of the pull cord by a user such that the user can apply a force on the pull cord to effect movement of the slider wedge 862 in the remote pull direction AA. The slider wedge 862 includes an outboard surface 874 that extends parallel to the pull axis PULL-D and forms a vertex 876 with the left, cap surface 872 and the slider wedge 862 includes an inboard surface 878 that forms a vertex 880 with the left cap surface 872 and that is at a lateral spacing BE-PS from the outboard surface 874 as measured at the left cap surface 872 in the direction of the transfer axis TRA-D. The inboard surface 878 forms a vertex 882 with a right cap surface 884 that is spaced from the left cap surface 872 as measured along the pull axis PULL-D and this vertex 882 of the inboard surface 878 of the slider wedge 862 is at a lateral spacing GR-PS from the outboard surface 878 that is greater than the lateral spacing BE-PS.

The remote force transmitting assembly 860 includes a transfer link 886 that is operatively coupled via a hoop 888 with a shuttle guide 890. The hoop 888 is secured to a top surface of the transfer link 886 via an adhesive securement or is alternatively integrally formed with the transfer link and the hoop 888 include an aperture through the shuttle guide 890 extends. The shuttle guide 890 is configured, for example, as a cylindrical rod extending parallel to the transfer axis TRA-D and having a distal end 892 and a proximate end (not shown) that is secured to a mounting surface such as, for example, a mounting surface in the form of the outer surface of a garment such as, for example, a vest. By virtue of the cooperative relationship of the hoop 888 and the shuttle guide 890, the transfer link 886 can be moved in a direction parallel to the transfer axis TRA-D such as, for example, in a transfer direction BB shown in FIG. 30.

The transfer link 866 includes a left cap surface 892 and an outboard surface 894, an inboard surface 896, and a right cap surface 898, the right cap surface 898 being spaced from the left, cap surface 892 as measured along the pull axis PULL-D. The inboard surface 896 extends parallel to the pull axis PULL-D. The outboard surface 894 of the transfer link 866 forms a vertex 960 with the left cap surface 892 that is at a lateral spacing OS-TR from the inboard surface 896 as measured at the left cap surface 892 in the direction of the transfer axis TRA-D. The outboard surface 894 of the transfer link 866 forms a vertex 962 with the right cap surface 898 and this vertex 962 of the outboard surface 894 of the transfer link 866 is at a lateral spacing LS-TR from the inboard surface 896 that is less than the lateral spacing OS-TR.

The inboard surface 896 of the transfer link 866 has a thrust down surface 964 that is planar and extends parallel to the pull axis PULL-D and has a leading edge 966 and a trailing edge 968. The trailing edge 968 of the thrust down surface 964 of the transfer link 866 extends parallel to the pull axis PULL-D and forms a vertex with a bottom surface of the transfer link 866 that is spaced from a top surface of the transfer link 866 on which the hoop 888 is mounted, as viewed in the direction of the decouple axis DEC-D. The trailing edge 968 of the thrust down surface 964 of the transfer link 866 is laterally spaced from the leading edge 966 of the thrust down surface 964, as viewed in the direction of the transfer axis TRA-D, in a direction opposite to the transfer direction BB.

The buckle rig assembly 830 includes a pulse element 970 having a sloped surface 972, a trigger 974, and a body portion 976 intermediate the sloped surface 972 and the trigger 974 as viewed in the direction of the transfer axis TRA-D. The sloped surface 972 increases in slope at a uniform rate in the direction of the sloped surface 972 toward the trigger 974 and the slope of the sloped surface 972 of the pulse element 970 is compatibly configured with respect to the planar thrust down surface 964 of the transfer link 886 such that the sloped surface 972 of the pulse element 970 and the thrust down surface 964 of the transfer link 886 slide relatively along one another when the thrust down surface 964 of the transfer link 886 is moved in the transfer direction BB, as will be described in more detail herein. The trigger 974 extends over the distal end 1048 of the cavity 1046 of the receptacle 1040 of the clip 1001 and has a distal end that is aligned with the release tab 1035 of the clip 1001 as viewed in the direction of the decouple axis DEC-D. The pulse element 970 is resiliently biased via a spring 978 that engages the pulse element 970 to bias the pulse element 970 in a direction opposite to a pulse direction CC that is parallel to the decouple axis DEC-D. It can be understood that the pull cord 870 of a respective lock module can be connected, for example, to the slider wedge 862 of another lock module and the pull cord 870 of this other lock module can be connected to the slider wedge 862 of a further lock module so as to achieve a configuration via which the application of a pull force on the pull cord 870 of a respective lock module will effect release of all of the thus interconnected lock modules.

Figure 26:
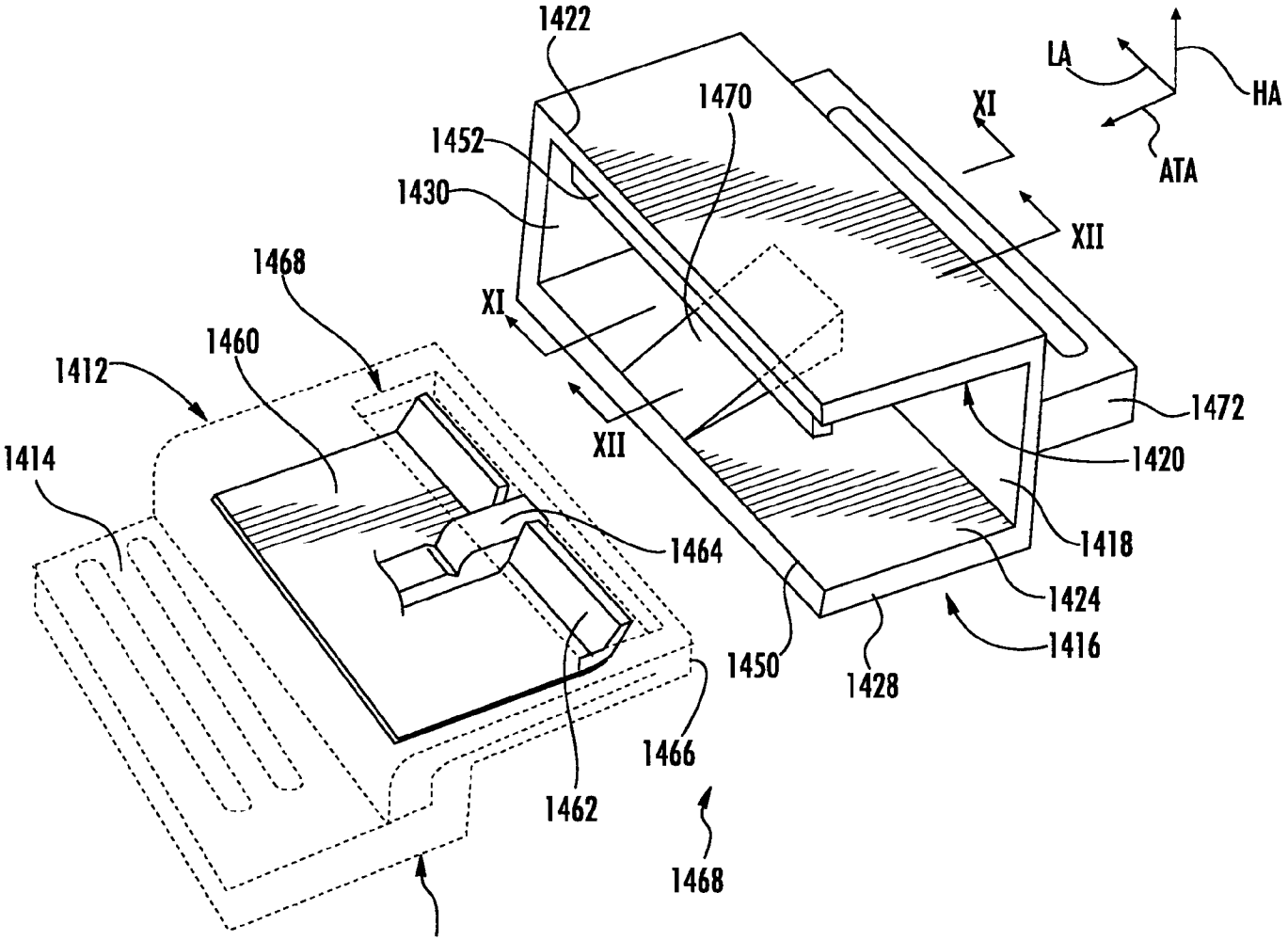
FIG. 26 is a perspective top view of a version of a buckle of the present invention in an unlocked position with the housing portion and the entry portion not in fully connected engagement with one another.

Reference is now had to FIGS. 26-30 for a description of a variation of the locking arrangement of the present invention which is operable to releasably secure a pair of items to one another such as, for example, a pair of web straps (not shown). The locking arrangement of the present invention in this connection is exemplarily shown in the form of a quick release buckle, hereinafter generally designated as a buckle 1408 and comprising a housing element 1416 and an entry element 1410, as seen in FIG. 26, which is a perspective top view of the buckle in an unlocked position with the housing portion and the entry portion not in fully connected engagement with one another. The entry element 1410 has a tang component 1412 and a strap connecting component 1414. The housing element 1416 includes a back wall 1418, a closed side wall 1420, a front slot wall 1422, a floor 1424, a ceiling wall 1426, an exit side wall 1428, and a strap connecting component 1472. The front slot wall 1422 includes a rectangular slot 1430. The various walls of the housing element 1416 delimit an interior volume dimensioned with respect to the tang component 1412 of the entry element 1410, in a manner to be described in more detail, such that the tang component 1412 is received within the interior volume delimited within the housing element 1416 in a lock position of the buckle. The description of the entry element 1410 and the housing element 1416 will be provided with reference to the three axis reference system comprised of the height axis HA, the longitudinal axis LA at ninety (90) degrees to the height axis HA, and the lateral axis ATA at ninety (90) degrees to both the height axis HA and the longitudinal axis LA.

The housing element 1416 also includes a stop ledge 1432 that extends along the longitudinal dimension of the front slot wall 1422 at a location above the slot 1430 and the stop ledge 1432 extends to the ceiling wall 1426. The stop ledge 1432 has a lateral dimension, as viewed parallel to the lateral extent of the closed side wall 1420, that is less than the lateral extent of the closed side wall 1420 and this lateral extent of the stop ledge 1432 is configured in correspondence with the dimensions of the tang component 1412 of the entry element 1410 so as to engage a predetermined extent of the tang component 1412. The entry element 1410 and the housing element 1416 operate in a manner which the two components can be releasably locked and unlocked. As seen in FIG. 26, the entry element 1410 can be moved in an insertion direction parallel to the depth direction to insert its tang component 1412 within the housing element 1416 and this insertion movement of the entry element 1412 into the housing element 1416 disposes the buckle 1408 in its locked disposition.

As seen in FIG. 26, the tang component 1412 cooperates with compatibly configured structures within the housing element 1416, to be described in more detail hereinafter, to positively prevent or preclude the tang component 1412 of the entry element 1410 from moving outwardly from the housing element 1416 in the locked disposition of the buckle 1408. To dispose the buckle 1408 in its locked position, the tang component 1412 of the entry element 1410 is inserted into the housing element 1416 to an extent such that the tang component 1412 will be disposed in a position to be engaged by the stop ledge 1432 of the housing element 1416 if an attempt is made to withdraw the tang component 1412 in a direction opposite to the insertion direction. The tang component 1412 includes a tang base 1460, a pair of weirs 1462 extending from the tang base 1460, and a pick off element 1464 extending from the tang base 1460 and located laterally between the pair of weirs 1462. The tang component 1412 also includes a top tier plate 1466 having a rise through slot 1468 having a lateral extent and the tang base 1460 and the top tier plate 1466 are both integrally formed with the strap connecting component 1414. The tang base 1460, the pair of weirs 1462 extending from the tang base 1460, and the pick off element 1464 are shown in solid lines and the top tier plate 1466 and the rise through slot 1468 are shown in broken lines in FIG. 26 for ease of illustration. A ramp 1470 is formed on the floor 1424 of the housing element 1416 and extends continuously upwardly, as viewed in the depth direction ATA, at a location laterally centrally of the floor 1424 in the direction from the front wall slot 1430 toward the strap connecting component 1414 of the housing element 1416.

Figure 27:
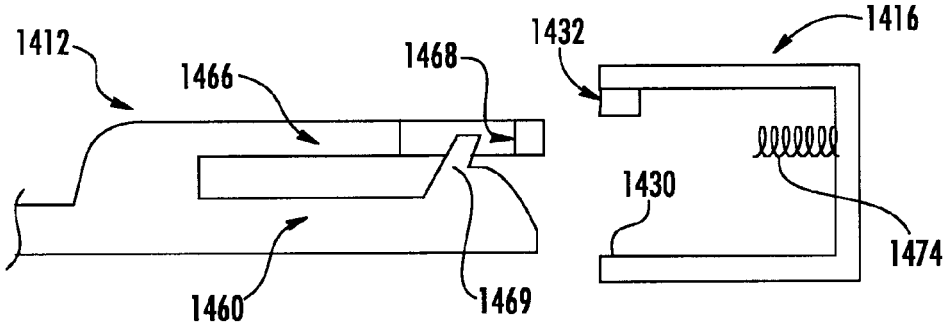
FIG. 27 is a side elevational view in partial section of the housing element of the buckle shown in FIG. 26 taken along the lines XI-XI shown in FIG. 26 during an initial locking movement of the entry element into the housing element.
Figure 28:
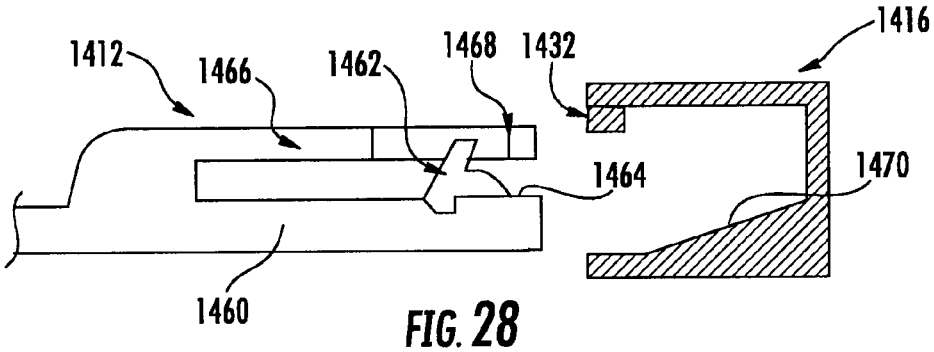
FIG. 28 is a side elevational view of the tang component of the entry element and a side elevational view in partial section of the housing element of the buckle shown in FIG. 26 taken along the lines XII-XII shown in FIG. 26 during the initial locking movement of the entry element into the housing element shown in FIG. 27.

As seen in FIG. 27, which is a side elevational view in partial section of the housing element 1416 taken along the lines XI-XI shown in FIG. 26 during an initial locking movement of the entry element 1410 into the housing element 1416, the top tier plate 1466 and the tang base 1460 extend generally parallel to one another at a height spacing from one another as the tang component 1412 is advanced toward the front wall slot 1430 of the housing element 1416 in an orientation in which the tang component 1412 will eventually advance past the front wall slot 1430 into the interior volume of the housing element 1416. The overall height of the tang component 1412 is this condition is less than the height dimension of the front wall slot 1430 of the housing element 1416 and the tops of the pair of weirs 1462 extend into, but not beyond, the rise through slot 1468. The housing element 1416 includes a spring element 1474 extending in the depth direction ATA from the back wall 1418. As seen in FIG. 28, which is a side elevational view of the tang component 1412 of the entry element 1410 and a side elevational view in partial section of the housing element 1416 taken along the lines XII-XII shown in FIG. 26 during the initial locking movement of the entry element 1410 into the housing element 1416 shown in FIG. 27, the ramp 1470 of the housing element 1416 is in a position to intercept the pick off element 1464 during a next increment of further advancing movement of the tang component 1412 into the housing element 1416.

Figure 29:
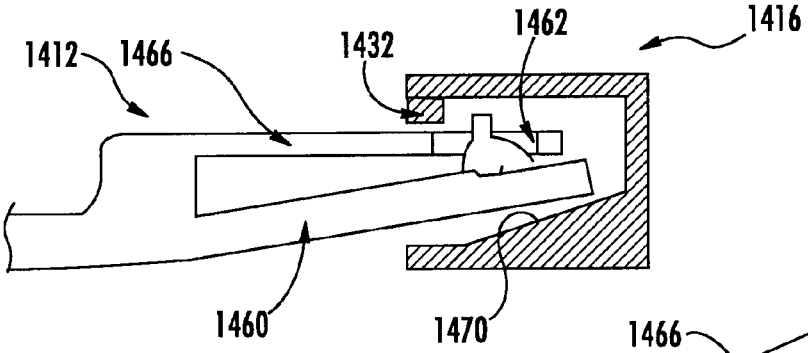
FIG. 29 is a side elevational view in partial section of the housing element of the buckle shown in FIG. 26 taken along the lines XII - XII shown in FIG. 26.
Figure 30:
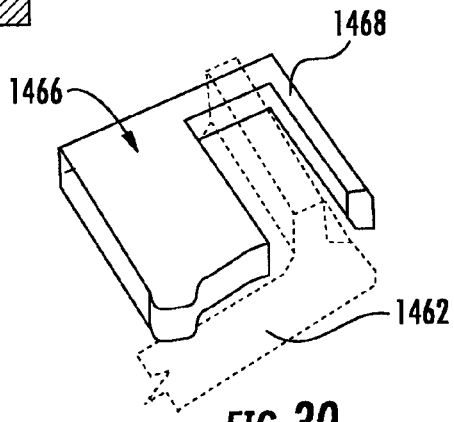
FIG. 30 is a top perspective view, in partial section, of a portion of the top tier plate and a left hand one of the pair of weirs of the buckle shown in FIG. 26.

Further advancing movement of the tang component 1412 during the initial locking movement of the entry element 1410 brings about an interception of the pick off element 1464 of the tang component 1412 by the ramp 1470 of the housing element 1416, as seen in FIG. 29, which is a side elevational view in partial section of the housing element 1416 taken along the lines XII-XII shown in FIG. 26. During this interception, the pick off element 1464 of the tang component 1412 moves upwardly along the ramp 1470 while, at the same time, the top surface of the top tier plate 1466 is engaged by the lower surface of the stop ledge 1432 of the housing element 1416 and this action brings about a movement of the tops of the pair of weirs 1462 relative to the rise through slot 1468 of the top tier plate 1466 such the tops of the pair of weirs 1462 project outwardly beyond the rise through slot 1468. FIG. 30, which is a top perspective view, in partial section, of a portion of the top tier plate 1466 and a left hand one of the pair of weirs 1462, shows the manner in which the tops of the pair of weirs 1462 project outwardly beyond the rise through slot 1468 of the top tier plate 1466. The spring element 1474 of the housing element 1416 engages the leading edge of the top tier plate 1466 of the tang component 1412 and resiliently biases the tang component 1412 in a direction opposite to the insertion direction such that the now-upwardly projected tops of the pair of weirs 1462 are maintained in engagement with the stop ledge 1432 of the housing element 1416. Any movement tending to promote withdrawal of the tang component 1412 of the entry element 1410 in the direction opposite to the insertion direction is resisted via the engagement by the stop ledge 1432 of the housing element 1416 with the pair of weirs 1462 of the tang component 1412 of the entry element 1410. A release of the entry element 1410 from the housing element 1416 is effected via a movement of the entry element 1410 and the housing element 1416 relative to one another in a direction parallel to the longitudinal axis LA and this direction is ninety (90) degrees to the lateral axis ATA. The variation shown in FIGS. 26-30 thus illustrates a configuration of the locking arrangement of the present invention in which the tang component can be disposed in the housing element without a deflection of the tang component or a deflection of the housing element in the height direction during the insertion movement.

Figure 31:
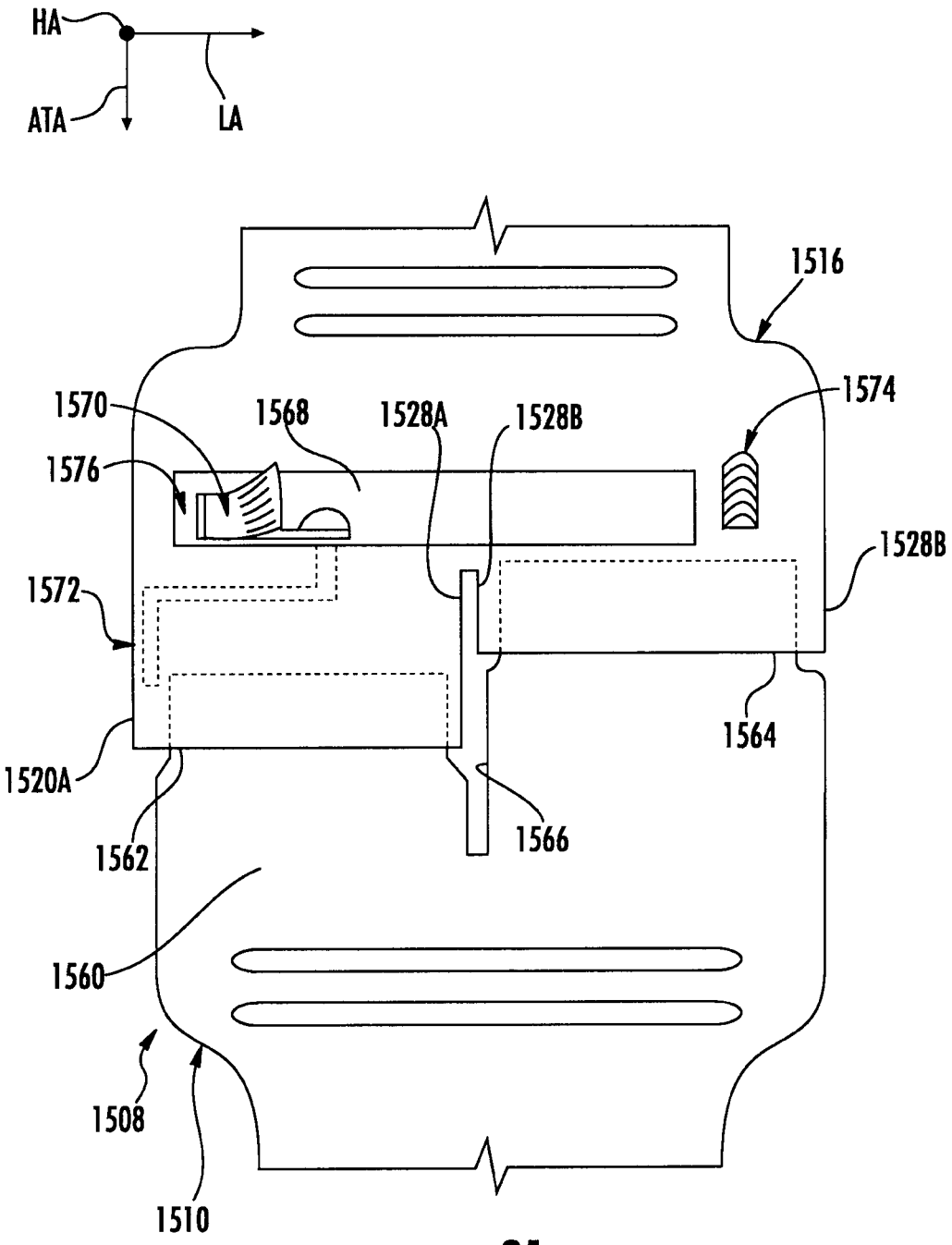
FIG. 31 is a top plan view of a further additional version of the locking arrangement of the present invention in the form of a quick release buckle.

As seen in FIG. 31, which is a top plan view of the locking arrangement of the present invention in the form of a quick release buckle, the quick release buckle, hereinafter designated as the buckle 1508, is operable to releasably secure a pair of adjacent surfaces to one another and these adjacent surfaces can be, for example, surfaces formed by a free end of a web strap and a free end of another web strap, surfaces formed by a pair of adjacent rigid structures, or any other pair of adjacent structures or components. The buckle 1508 includes a housing element 1516 and an entry element 1510. The description of the entry element 1510 and the housing element 1516 will be provided with reference to a three axis reference system comprised of a height axis HA, a longitudinal axis LA at ninety (90) degrees to the height axis HA, and a lateral axis ATA at ninety (90) degrees to both the height axis HA and the longitudinal axis LA. The entry element 1510 includes a tang component 1512 and a strap connecting component 1514. The housing element 1516 includes a back wall, a floor, and a ceiling wall. The various walls of the housing element 1516 delimit an interior volume dimensioned with respect to the tang component 1512 of the entry element 1510, in a manner to be described in more detail, such that the tang component 1512 is received within the interior volume delimited within the housing element 1516 in a lock position of the locking arrangement. The entry element 1510 may be formed, for example, of a suitable plastic material, a metal material, a combination of a metal and plastic material, or any other suitable material.

The tang component 1512 is comprised of a tang base 1560 and a left hand tang plug 1562 and a right hand tang plug 1564, each of which is integrally formed with the tang base 1560. The tang base 1560 is integrally formed with the strap connecting component of the entry element 1510. The left hand tang plug 1562 and the right hand tang plug 1564 each have a lateral dimension less than one-half the overall lateral dimension of the tang base 1560 and the left hand tang plug 1562 and the right hand tang plug 1564 are spaced from each in the lateral direction such that they together delimit a flexion gap 1566. Each of the left hand tang plug 1562 and the right hand tang plug 1564 is configured to be inserted into the housing element 1516 to effect releasable locking engagement of the entry element 1510 with the housing element 1516. The left hand tang plug 1562 and the right hand tang plug 1564 are offset to each other relative to the depth direction ATA such that the right hand tang plug 1564 extends further forward than the left hand tang plug 1562, as viewed in the insertion direction.

The housing element 1516 has a corresponding structure on one lateral side thereof that is compatibly configured with respect to the left, hand tang plug 1562 to releasably retain the left hand tang plug following its insertion into this corresponding structure and has a corresponding structure on another lateral side thereof that is compatibly configured with respect to the right hand tang plug 1564 to releasably retain the right hand tang plug following its insertion into this corresponding structure. Each of these pair of corresponding structures of the housing element 1516 has a front wall slot through with the respective associated one of the left hand tang plug 1562 and the right hand tang plug 1564 can be inserted and a stop ledge to block withdrawal movement of the respective tang plug in a direction opposite to the insertion direction. The front wall slots of the pair of corresponding structures of the housing element 1516 are offset from one another in the depth direction ATA such that the front wall slot of the respective corresponding structure of the housing element 1516 that receives the left hand tang plug 1562 is further forward as viewed in a direction opposite to the insertion direction than the front wall slot of the respective corresponding structure of the housing element 1516 that receives the right hand tang plug 1564 and the offset of the front wall slots of the corresponding structures of the housing element 1516 is selected such that each of the left hand tang plug 1562 and the right hand tang plug 1564 substantially simultaneously enters the respective corresponding structure of the housing element 1516 as the other of the left hand tang plug 1562 and the right hand tang plug 1564 enters the respective corresponding structure of the housing element 1516 upon insertion of the tang component 1512 into the housing element 1516.

One of the pair of corresponding structures of the housing element 1516 has a closed side wall 1520A and an exit side wall 1528A having an exit slot through which the left hand tang plug 1562 can be moved in a lateral movement and the other of the pair of corresponding structures of the housing element 1516 has a closed side wall 1520B and an exit side wall 1528B having an exit slot through which the right hand tang plug 1564 can be moved in a lateral movement right hand tang plug 1564. The exit side walls 1528A. 1528B both open toward the same respective lateral side of the housing element 1516. Each of the left hand tang plug 1562 and the right hand tang plug 1564 is released from its engagement with the respective corresponding structures of the housing element 151 via a lateral release movement in the lateral direction from the closed side wall 1520A, 1520B toward the exit side wall 1528A, 1528B and this release motion is effected, for example, by a movement of the tang component 1512 laterally. FIG. 31 also illustrates that this variation of the buckle of the present invention can be provided with a manual release actuator that is located within the "footprint" of the housing element 1516 and this manual release actuator is in the form of a slide tray 1568 extending laterally on the housing element 1516, a sliding finger mount 1570 movably mounted in the slide tray 1568 for lateral sliding movement, a transfer link 1572 extending from the sliding finger mount 1570 to a location within the housing element 1516 for engaging the left, hand tang plug 1562 of the tang component 1512 in its inserted disposition, and a finger brace projection 1574 projecting upwardly from the top surface of the housing element 1516. A user disposes, for example, an index finger of one hand on the sliding finger mount 1570 and the thumb of the same hand on the finger brace projection 1574 and applies a force to effect sliding movement of the sliding finger mount 1570 toward the finger brace projection 1574. The transfer link 1572 is correspondingly moved laterally and engages the respective end of the left hand tang plug 1562 of the tang component 1512 adjacent the closed side wall to drive the tang component 1512 laterally. The left hand tang plug 1562 of the tang component 1512 and the right hand tang plug 1564 of the tang component 1512 exits the respective corresponding structures of the housing element 1516 at substantially the same time once the tang component 1512 has been laterally moved a predetermined distance. A spring 1576 attached to the housing element 1516 and to the sliding finger mount 1570 returns the sliding finger mount 1570 to its home position. It can be appreciated that this variation of the buckle permits the tang component to be moved laterally out of locking engagement with the housing element via a reduced lateral movement relative to variations of the buckle having a single tang received in a housing element of equivalent lateral width.

Figure 32:
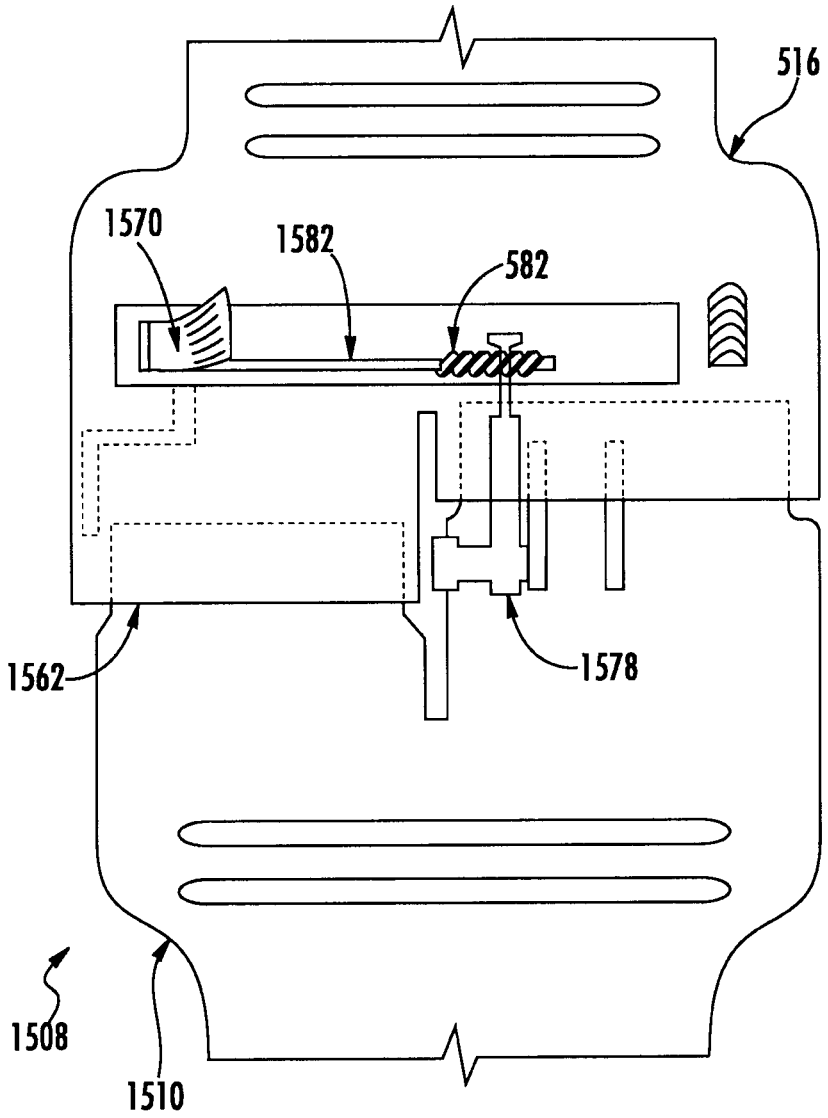
FIG. 32 is a top plan view of a modification of the buckle shown in FIG. 31.

As seen in FIG. 32, which is a top plan view of a modification of the buckle shown in FIG. 31, the buckle 1508 is modified to include a pivotable block arm 1578 that is movably mounted to the housing element 1516 for pivoting between a block position, in which the block arm 1578 is in a position to engage an end of the left hand tang plug 1562 of the tang component 1512 in its inserted disposition so as to block lateral movement of the left hand tang plug 1562 of the tang component 1512 out of the respective corresponding structure of the housing element 1516, and a non-blocking position, in which the block arm 1578 does not block lateral movement of the left hand tang plug 1562 of the tang component 1512. One end of the block arm 1578 has a helical thread structure that is meshingly engaged by a corresponding helically threaded drive gear 1580 rotatably mounted on a rod 1582 fixedly mounted to the sliding finger mount 1570. The initial sliding movement of the sliding finger mount 1570 is operable to pivot the block arm 1578 from its block position to its non-block position while, as described hereinabove, sliding movement of the sliding finger mount 1570 operates to slide the tang component 1512 laterally. This modification of the buckle 1508 thus advantageously operates to prevent inadvertent lateral movement of the tang component 1512 out its locked disposition relative to the housing element 1516.

Figure 34:
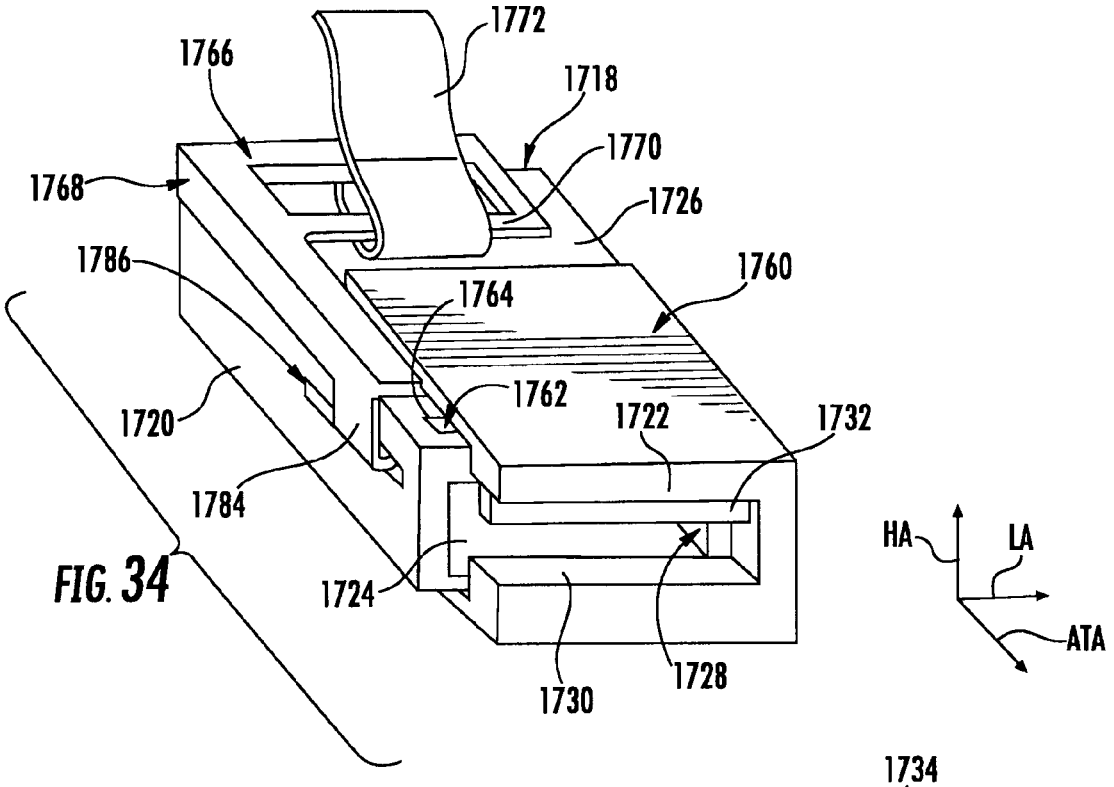
FIG. 34 is a perspective view of an additional supplemental variation of the locking arrangement of the present invention in a disposition ready for insertion of a tang component.
Figure 33:
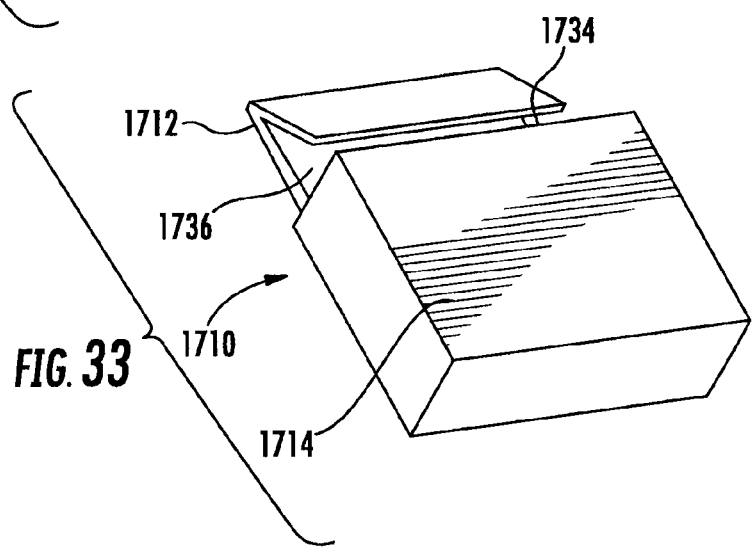
FIG. 33 is a depiction of a three axis reference legend.

A variation of the locking arrangement is described with reference to FIG. 33, which shows a three axis reference legend. FIG. 34, which is a perspective view of the variation of the locking arrangement in a disposition ready for insertion of a tang component, and FIG. 35, which is a perspective view of the variation of the locking arrangement shown in FIG. 34 in a disposition in which a tang component has been released. The entry portion is in the form of an entry element 1710 and the entry element 1710 includes a tang component 1712 and a strap connecting component 1714. The housing portion is in the form of a housing element 1716 and includes a back wall 1718, a closed side wall 1720, a front slot wall 1722, a floor 1724, a ceiling wall 1726, and an exit side wall 1728. The front slot wall 1722 includes a rectangular slot 1730. The various walls of the housing element 1716 delimit an interior volume dimensioned with respect to the tang component 1712 of the entry element 1710, in a manner to be described in more detail, such that the tang component 1712 is received within the interior volume delimited within the housing element 1716 in a lock position of the locking arrangement. The description of the entry element 1710 and the housing element 1712 will be provided with reference to the three axis reference system shown in FIG. 33 comprised of a height axis HA, a longitudinal axis LA at ninety (90) degrees to the height axis HA, and a lateral axis ATA at ninety (90) degrees to both the height axis HA and the longitudinal axis LA.

The housing element 1716 also includes a stop ledge 1732 that extends along the longitudinal dimension of the front slot wall 1722 at a location above the slot 1730 and the stop ledge 1732 extends to the ceiling wall 1726. The stop ledge 1732 has a lateral dimension, as viewed parallel to the lateral extent of the closed side wall 1720, that is configured in correspondence with the dimensions of the tang component 1712 of the entry element 1710 so as to engage a predetermined extent of the tang component 1712, in a manner that will be described in more detail. The entry element 1710 may be formed, for example, of a suitable plastic material, a metal material, a combination of a metal and plastic material, or any other suitable material. The entry element 1710 is configured to be inserted through the slot 1730 of the housing element 1716 along a lock insertion axis, whereupon the insertion of the entry element 1710 through the slot 1730 is performed in a series of steps comprising a step of orienting the tang component 1712 of the entry element 1710 such that the longitudinal dimension of the tang component 1712 is parallel to the longitudinal dimension of the slot 1730 and a step of advancing the entry element 1710 in the locking arrangement insertion direction such that the tang component 1712 moves inwardly into the housing element 1716 laterally beyond the front slot wall 1722, with the insertion of the tang component 1712 ceasing once a top longitudinal edge 1734 of the tang component 1712 has advanced inwardly into the housing element 1716 beyond the stop ledge 1732. The tang component 1712 of the entry element 1710 is configured with a letter "V"—cross-sectional shape such that the top longitudinal edge 1734 of the tang component 1712 can be forced in the height axis HA direction toward a tang base 1736 against a resilient bias of the tang component and this resilient bias of the tang component 1712 automatically returns the top longitudinal edge 1734 to its non-pressed position once a pressing force on the tang component has ceased.

The front wall 1720 of the housing element 1716 is carried on a throw carriage 1760 having a pair of opposed ribs 1762 each of which is slidably retained in a guide slot 1764 formed in a respective one of the top surface of the ceiling wall 1726 and the bottom surface of the floor 1724. The throw carriage 1760 is laterally displaceable relative to a main body portion of the housing element 1716 in a guided manner in which the ribs 1762 slide along the guide slots 1764. In the disposition of the throw carriage 1760 shown in FIG. 34 in which the throw carriage 1760 is disposed to the greatest extent permitted laterally toward the closed side wall 1720, the tang component 1712 can be advanced through the front wall slot 1730 to assume its retained disposition in the housing element 1716.

Figure 35:
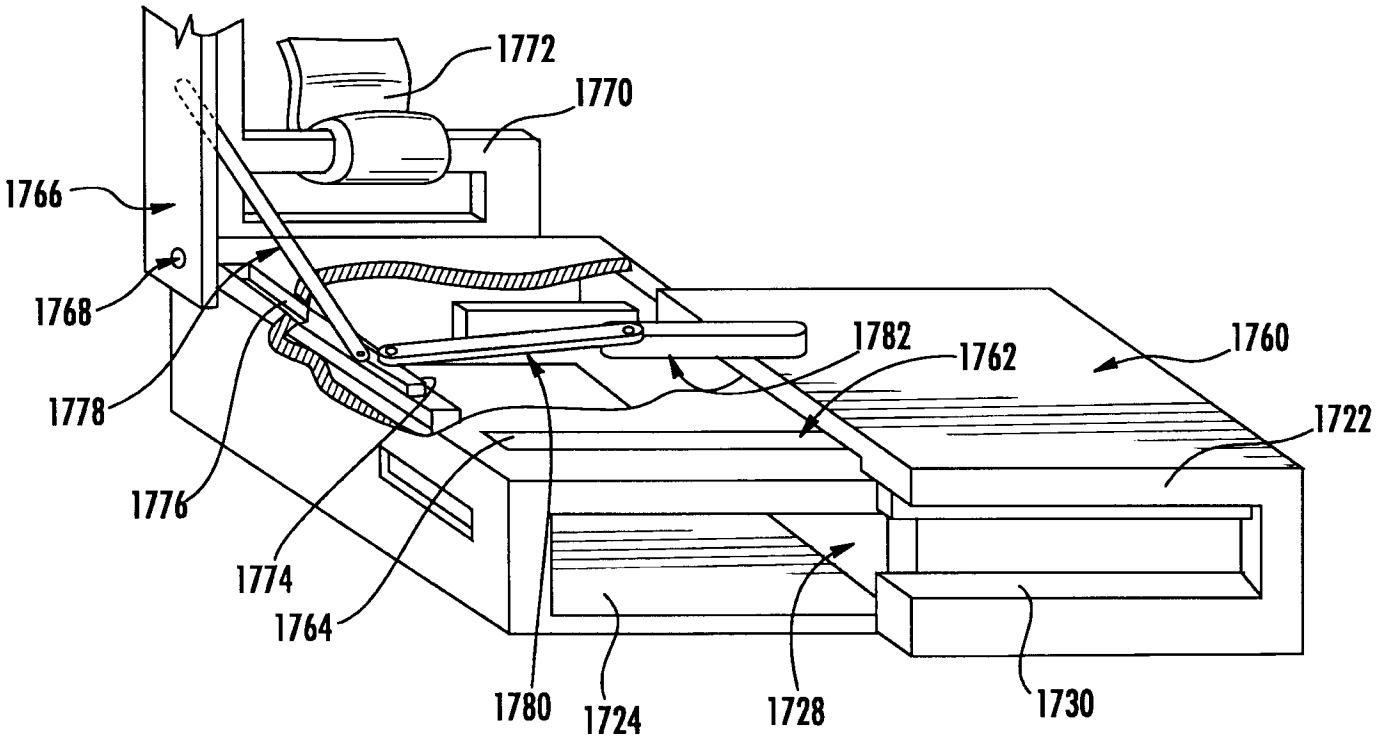
FIG. 35 is a perspective view of the variation of the locking arrangement shown in FIG. 34 in a disposition in which a tang component has been released.

With reference now to FIG. 35, the housing element 1716 also includes a lift rig 1766 having a leg pivotally connected via a pivot mount 1768 to the closed side wall 1720. The lift rig 1766 includes a strap lashing bar 1770 to which, for example, an end of a web strap 1772 can be coupled. A slider link 1774 is slidably retained in a travel slot 1776 formed in the top surface of the ceiling wall 1726. One end of a drive rod 1778 is pivotally mounted to the leg of the lift rig 1766 at a spacing from the pivot mount 1768 and an opposite end of the drive rod 1778 is pivotally mounted to the slider link 1774. A transfer rod 1780 has one end pivotally connected to the slider link 1774 and an opposite end pivotally connected to one end of a driven rod 1782. An opposite end of the driven rod 1782 is pivotally connected to the throw carriage 1760. As seen in FIG. 34, the leg of the lift rig 1766 has a catch flange 1784 configured to be releasably retained in a retention slot 1786 in the closed side wall 1720.

In the disposition of the throw carriage 1760 shown in FIG. 18 in which the throw carriage 1760 is disposed to the greatest extent permitted laterally toward the closed side wall 1720, the catch flange 1784 of the leg of the lift rig 1766 is releasably retained in the retention slot 1786 in the closed side wall 1720 and the strap lashing bar 1770 is adjacent the ceiling wall 1726. In this disposition, the tang component 1712 can be advanced through the front wall slot 1730 to assume its retained disposition in the housing element 1716. In the event that a user desires to release the tang component 1712 from its retained disposition in the housing element 1716, the user manipulates the strap end 1772 via, for example, exerting a tugging force thereon, so as to pivot the leg of the lift rig 1766 about the pivot mount 1768 and thereby release the catch flange 1784 of the leg of the lift rig 1766 from its retained disposition in the retention slot 1786 in the closed side wall 1720. This pivoting movement of the lift rig 1766 brings about, as seen in FIG. 35, a movement of the slider link 1774 which, in turn, produces a lateral movement of the throw carriage 1760 in a manner in which the bulk of the front wall 1722 moves laterally outwardly of the main body of the housing element 1716. This lateral movement of the throw carriage 1760 is guided by the sliding movement of the ribs 1762 in the slots 1764. The lateral movement of the throw carriage 1760 in a manner in which the bulk of the front wall 1722 moves laterally outwardly of the main body of the housing element 1716 thus permits the tang component 1712 to move out of its retained disposition in the housing 1716, as the top longitudinal edge 1734 of the tang component 1712 is no longer in engagement with the stop ledge 1732.

Figure 36:
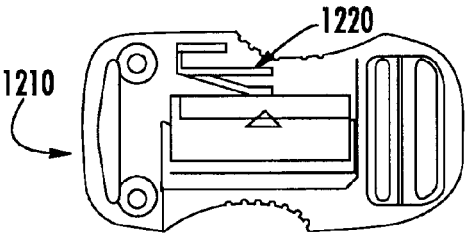
FIG. 36 is a top elevational view of a quick release buckle.
Figure 37:
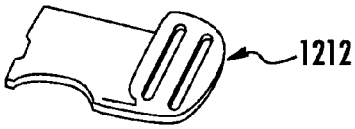
FIG. 37 is a perspective view of the entry element of the quick release buckle shown in FIG. 36.
Figure 38:
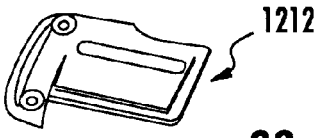
FIG. 38 is a perspective view of the housing element of the quick release buckle shown in FIG. 36.
Figure 39:
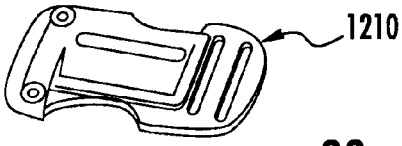
FIG. 39 is a perspective view of the quick release buckle shown in FIG. 36 in a locked condition.
Figure 40:
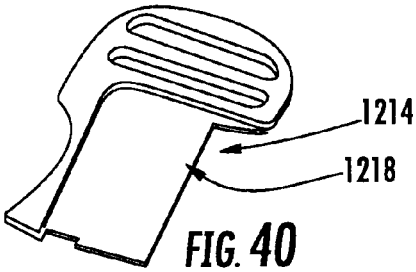
FIG. 40 is an enlarged bottom perspective view of the entry element of the quick release buckle shown in FIG. 36.
Figure 41:
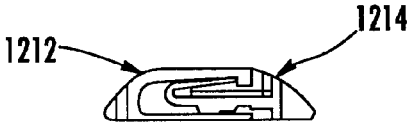
FIG. 41 is a sectional side elevation view of the quick release buckle shown in FIG. 36.
Figure 42:
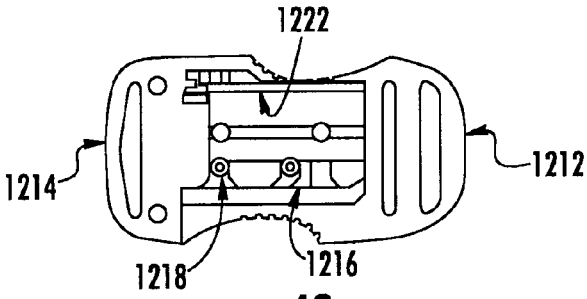
FIG. 42 is a bottom sectional view of the quick release buckle shown in FIG. 36.
Figure 43:
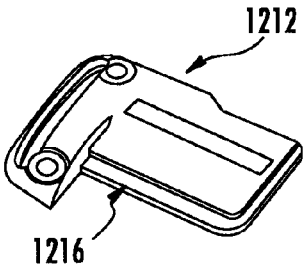
FIG. 43 is a top perspective view of the housing element of the quick release buckle shown in FIG. 36.
Figure 44:
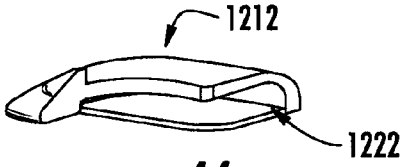
FIG. 44 is a perspective view of the housing element of the quick release buckle shown in FIGS. 36.
Figure 45:
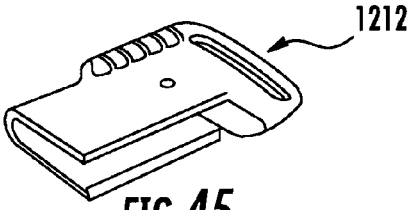
FIG. 45 is a bottom perspective view of the housing element o the quick release buckle shown in FIG. 36.

A further exemplary configuration of the locking arrangement of the present invention is described with reference to FIG. 36 which is a top elevational view of a quick release buckle, FIG. 37 which is a perspective view of the entry element of the quick release buckle shown in FIG. 36, FIG. 38 which is a perspective view of the housing element of the quick release buckle shown in FIG. 36, FIG. 39 which is a perspective view of the quick release buckle shown in FIG. 36 in a locked condition, FIG. 40 which is an enlarged bottom perspective view of the entry element of the quick release buckle shown in FIG. 36, FIG. 41 which is a sectional side elevation view of the quick release buckle shown in FIG. 36, FIG. 42 which is a bottom sectional view of the quick release buckle shown in FIG. 36, FIG. 43 which is a top perspective view of the housing element of the quick release buckle shown in FIG. 36, FIG. 44 which is a perspective view of the housing element of the quick release buckle shown in FIG. 36, and FIG. 45 which is a bottom perspective view of the housing element of the quick release buckle shown in FIG. 36. The locking arrangement is generally designated as a quick release buckle 1210 and includes a housing element 1212 and an entry element 1214. The housing element 1212 includes a plurality of guide channels 1216 and the entry element 1214 includes a plurality of annular pegs 1218. The entry element 1214 can be inserted into the housing element 1212 via movement of the entry element 1214 an insertion direction and, as seen in particular in FIG. 42, this insertion produces a locked condition of the quick release buckle 1210. As a result of this insertion movement, the annular pegs 1218 of the entry element 1214 are received in the guide channels 1216 of the housing element 1212 and a spring 1220 secured within the housing element 1212, as seen in FIG. 36, releasably prevents the entry element 1214 from being further inserted into the housing element 1212 until a further insertion force is applied. Upon the application of a further insertion force, the annular pegs 1218 of the entry element 1214 that are received in the guide channels 1216 of the housing element 1212 are each displaced into a respective one of a pair of release channels 1222 of the housing element 1212, as shown in FIG. 42, and the housing element 1212 and the entry element 1214 can then be released from their locked condition via movement of one or both of the housing element 1212 and the entry element 1214 in a direction transverse to the insertion direction of the entry element 1214 into the housing element 1212.

What is claimed is:

1. A locking arrangement comprising:

an entry element;

a housing element;

the entry element, having a portion that is selectively disposable in the housing element via a movement of the portion of the entry element and the housing element relatively toward one another in an insertion direction, the entry element and the housing element being in a releasably secured disposition when the portion of the entry element has been disposed in the housing element via a movement of the portion of the entry element and the housing element relatively toward one another in the insertion direction, and the entry element and the housing element being releasable from their releasably secured disposition via a movement in a release direction that is other than a direction opposite to the insertion direction; and an engagement element on the entry element and an engagement element on the housing element interlocking with each other when the portion of the entry element has been disposed in the housing element in a manner which resists relative movement of the entry element and the housing element in the release direction.

2. The locking arrangement of claim 1, wherein the engagement element on the entry element and the engagement element on the housing element are released from engagement with each other by application of a force above a minimum force.

3. The locking arrangement of claim 1, wherein the engagement element on the entry element and the engagement element on the housing element are released from engagement with each other by relative movement of the entry element and the housing element.

4. The locking arrangement of claim 3, wherein relative movement of the entry element and the housing element to release the engagement element on the entry element and the engagement element on the housing element from engagement with each other is resisted by a biasing component.

5. The locking arrangement of claim 4, which further comprises:

a garage rail secured to one of the entry element and the housing element, the garage rail extending in a direction generally parallel to the release direction;

a tang rail secured to the other one of the entry element and the housing element, the tang rail extending in a direction generally parallel to the release direction;

the garage rail and the tang rail being non-parallel to each other; and a travel cart selectively engaging said tang rail and said garage rail such that movement of the travel cart in a direction generally parallel to the release direction moves the entry element and the housing element relative to each other so as to release the engagement element on the entry element and the engagement element on the housing element from engagement with other.

6. The locking arrangement of claim 3, which further comprises:

a garage rail secured to one of the entry element and the housing element, the garage rail extending in a direction generally parallel to the release direction;

a tang rail secured to the other one of the entry element and the housing element, the tang rail extending in a direction generally parallel to the release direction;

the garage rail and the tang rail being non-parallel to each other; and a travel cart selectively engaging said tang rail and said garage rail such that movement of the travel cart in a direction generally parallel to the release direction moves the entry element and the housing element relative to each other so as to release the engagement element on the entry element and the engagement element on the housing element from engagement with other.

7. The locking arrangement of claim 1, wherein the release direction is at a right angle to the insertion direction.

8. A buckle rig assembly comprising a plurality of individual locking devices each operable to be disposed in a locking disposition and an unlocked disposition, each of the individual locking devices including:

an entry element, a housing element, the entry element, having a portion that is selectively disposable in the housing element via a movement of the portion of the entry element and the housing element relatively toward one another in an insertion direction, the entry element and the housing element being in a releasably secured disposition when the portion of the entry element has been disposed in the housing element via a movement of the portion of the entry element and the housing element relatively toward one another in the insertion direction, the entry element and the housing element being releasable from their releasably secured disposition via a movement in a release direction that is other than a direction opposite to the insertion direction, and an engagement element on the entry element and an engagement element on the housing element mechanically engaging each other when the portion of the entry element has been disposed in the housing element in a manner which resists relative movement of the entry element and the housing element in the release direction, the engagement element on the entry element and the engagement element on the housing element being released from mechanical engagement with each other by relative movement of the entry element and the housing element; and a cable arranged so that pulling on the cable releases the entry element from the housing element of each of the individual locking devices.

9. The buckle rig assembly of claim 8, wherein the release direction is at a right angle to the insertion direction.

10. A buckle rig assembly comprising a plurality of individual locking devices each operable to be disposed in a locking disposition and an un locked disposition, each of the individual locking devices including:

an entry element, a housing element, the entry element, having a portion that is selectively disposable in the housing element via a movement of the portion of the entry element and the housing element relatively toward one another in an insertion direction, the entry element and the housing element being in a releasably secured disposition when the portion of the entry element has been disposed in the housing element via a movement of the portion of the entry element and the housing element relatively toward one another in the insertion direction, the entry element and the housing element being releasable from their releasably secured disposition via a movement in a release direction that is other than a direction opposite to the insertion direction, an engagement element on the entry element and an engagement element on the housing element mechanically engaging each other when the portion of the entry element has been disposed in the housing element in a manner which resists relative movement of the entry element and the housing element in the release direction, the engagement element on the entry element and the engagement element on the housing element being released from engagement with each other by relative movement of the entry element and the housing element, a garage rail secured to one of the entry element and the housing element, the garage rail extending in a direction generally parallel to the release direction, a tang rail secured to the other one of the entry element and the housing element, the tang rail extending in a direction generally parallel to the release direction, the garage rail and the tang rail being non-parallel to each other, and a travel cart selectively engaging said tang rail and said garage rail such that movement of the travel cart in a direction generally parallel to the release direction moves the entry element and the housing element relative to each other so as to release the engagement element on the entry element and the engagement element on the housing element from mechanical engagement with other; and a cable attached to the travel cart so that pulling on the cable releases the entry element from the housing element of each of the individual locking devices.

11. The buckle rig assembly of claim 10, wherein the release direction is at a right angle to the insertion direction.

* * * * *